United States Patent [19]

Odom

[11] Patent Number: 4,498,893

[45] Date of Patent: Feb. 12, 1985

[54] CASE ERECTOR AND BOTTOM SEALER APPARATUS

[75] Inventor: Robert E. Odom, Blaine, Minn.

[73] Assignee: Bemis Company, Inc., Minneapolis, Minn.

[21] Appl. No.: 343,451

[22] Filed: Jan. 28, 1982

[51] Int. Cl.[3] ..... B31B 1/80

[52] U.S. Cl. ..... 493/12; 493/33; 493/125; 493/126; 493/141; 493/316

[58] Field of Search ..... 493/125, 124, 123, 122, 493/126, 180, 182, 12, 13, 14, 15, 141, 27, 32, 33, 316, 313

[56] References Cited

U.S. PATENT DOCUMENTS

| | | | |
|---|---|---|---|
| Re. 30,921 | 5/1982 | McDowell | 493/124 |
| 3,253,389 | 5/1966 | Miller et al. | 493/131 X |
| 3,537,361 | 11/1970 | Derederian | 493/125 X |
| 3,831,342 | 8/1974 | Rejsa | 53/353 X |
| 3,994,389 | 11/1976 | Blair | 198/719 |
| 4,033,242 | 7/1977 | Rice et al. | 493/126 |
| 4,041,850 | 8/1977 | Reichert | 493/123 |
| 4,044,657 | 8/1977 | Reichert | 493/123 |
| 4,133,254 | 1/1979 | Odom et al. | 493/125 |
| 4,201,118 | 5/1980 | Calvert et al. | 493/125 |
| 4,312,617 | 1/1982 | Livingston et al. | 414/121 |

*Primary Examiner*—Rodney H. Bonck

*Assistant Examiner*—David D. House

*Attorney, Agent, or Firm*—Clayton R. Johnson

[57] ABSTRACT

Case erector and bottom sealer apparatus having a pick up assembly for grippingly engaging a flat folded case blank on the top of a plurality of case blanks in vertical stacked relationship and elevating and moving the picked up blank forwardly, an infeed conveyor assembly for receiving the picked up case blank in its forward position and moving it to an erector station, an erector assembly at the erector station for grippingly engaging opposite sides of the blank and opening the case blank, folder assemblies movable between retracted and folded positions for first folding the bottom minor flaps of the erected blank and then partially folding the bottom major flaps to retain the bottom minor flaps in a folded condition, a walking stick assembly for moving the erected case from the erector station to a compression station, a glue gun assembly for applying adhesive to the bottom minor flaps as the erected case is moved to the compression station, a compression assembly at the compression station to complete the folding of the bottom major flaps and compress the folded bottom major and minor flaps to complete the formation of the sealed case bottom closure, and controls for controlling the operation of the above mentioned assemblies.

16 Claims, 23 Drawing Figures

10
18
513
B
24
12
10
277
325
345
16
14
55
14
17
48
47
101
272
96
277
46
67
45
68
38
37
39
85
74
26
111
75
81
86
76
118
795
87
136
135
32
35
36
34
88
41
15
12
139
119
138
27
B
14
16
56
14
55
54
57
65
62
59
46
14
58
46
47
49
50
103
47
102
101
64
50
63
100
96
104
66
45
99
99
67
68
67
91
83
85
75
277

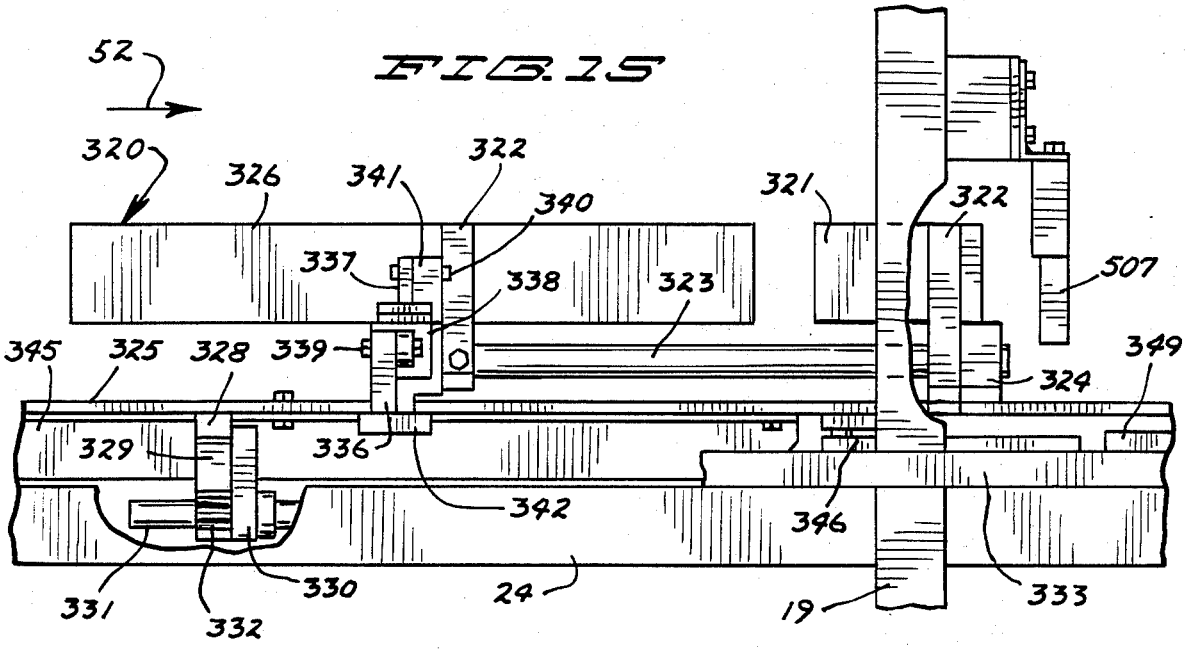
FIG. 15
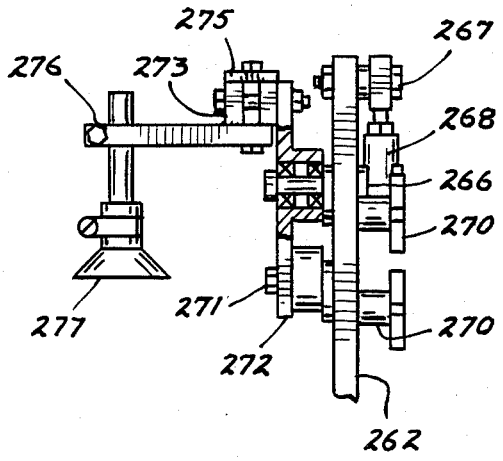
FIG. 14
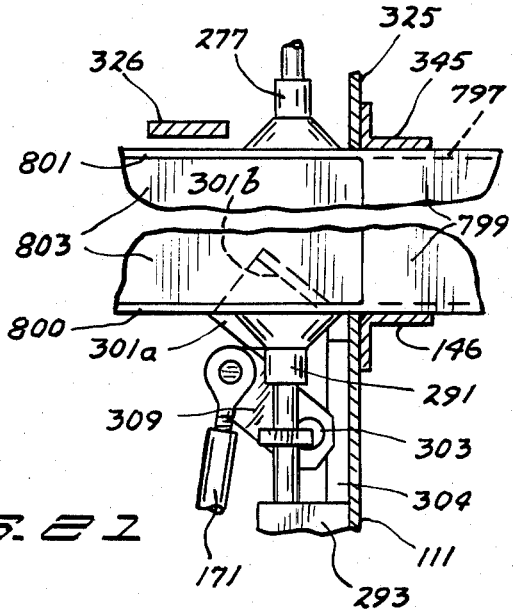
FIG. 21
| | DWELL | | | |
|---|---|---|---|---|
| ERECTING ARM | RISE | DWELL | FALL | |
| REAR FLAP FOLDER | DWELL | IN | DWELL OUT | DWELL |
| FRONT FLAP FOLDER + UPPER FLAP FOLDER | OUT | IN | | |
| LOWER FLAP FOLDER + CASE STOP | DWELL | DOWN UP | DWELL | |
| WALKING STICK | CASE TRANSFER | | | |
| COMPRESSION RAM | IN | DWELL | OUT | DWELL |
815
FIG. 19

L5
653
654
L4
540
504
660
657
661
655
658
675
656
665
671
672
505
662
673
667
664
674
676
677
541
184
679
460
183
678

702
-701-
703
616
615
708
707
713
723
628
627
706
713
709
710
711
712
725
726
720
620
718
716
55
54
62
728
727
717
63
719
724
730
735
733
643
642
734
67
731
732
745
679
678
746
253
252
338
738
337
744
742
739
749
748
747
743
741
740
759
277
758
757
676
755
675

291
754
753
756
390
-391-
548
771
770
767
775
772
765
763
776
773
787
781
764
766
549
788
785
780
779
786
673
672
704
700
366
782
784
783

CASE ERECTOR AND BOTTOM SEALER APPARATUS

BACKGROUND OF THE INVENTION

Apparatus for removing a flat folded case blank from a stack of case blanks, opening the case blank, and applying adhesive and folding the blank bottom flaps to form a sealed case bottom closure.

In the prior art it is old to provide machines for picking up the top case blank on a vertical stack of flat folded case blanks, open the case blank, folding the minor flaps and then partially folding the major flaps to hold the major flaps in a folded condition, applying adhesive to the folded minor flaps and then completing the folding of the major flaps to form a sealed bottom closure, for example see U.S. Pat. No. 4,133,254. Further, it is old to mount vacuum cups on a carriage for vertical movement relative thereto and horizontally therewith for picking up a folded case blank and feeding the picked up blank to a combination roller and belt conveyor assembly which further advances the folded case blank, for example see U.S. Ser. No. 54,693, filed July 5, 1979, now U.S. Pat. No. 4,312,617.

In order to provide apparatus that can erect flat folded case blanks and form sealed case bottom closures at a relatively high rate of speed, and incorporate various safety features that automatically stop the machine and/or advancement of a case blank in the event a blank is not properly positioned at various times during a cycle of operation, this invention has been made.

SUMMARY OF THE INVENTION

Case erector and bottom sealer apparatus that includes a pick up assembly for picking up a flat folded case blank and feeding it forwardly, a case infeed assembly for advancing a picked up case blank to an erecting station, upper and lower vacuum cup assemblies for gripping the major side walls of the folded case blank at the erecting station to erect the case blank at the erecting station, mechanically operated flap folders for first folding the bottom minor flaps and then partially folding a bottom major flap of the erected case blank, a major flap assembly for partially folding the other bottom major flap, a compression assembly for compressing the bottom flaps and firmly adhere the bottom flaps together and an adhesive applying device for applying adhesive to bottom flaps prior to the bottom flaps being compressed.

One of the objects of this invention is to provide a new and novel machine for opening a flat folded case blank and forming a sealed bottom closure. In furtherance of the last mentioned object, it is another object of this invention to provide a machine for erecting case blanks and forming sealed bottom closures at a relatively high rate of speed. It is a further object of this invention to provide in a machine for forming sealed case bottom closures, new and novel control means to automatically stop the machine and/or advancement of a case blank in the event a case blank is out of a proper position for an ensuing operation during the process of forming a sealed case bottom closure from a case blank that was in a flat folded condition.

BRIEF DESCRIPTION OF THE DRAWINGS

FIGS. 1A and 1B when arranged along side one another with lines A—A of FIGS. 1A and B—B of 1B aligned form a composite horizontal view of the case erector and bottom sealer apparatus of this invention in conjunction with the conveyor assembly for feeding flat folded case blanks thereto, various parts being broken away and other parts not being shown;

FIG. 14 is a fragmentary rear end view of part of the erector assembly in the position of FIG. 9 with a part broken away;

FIG. 15 is a fragmentary plan view of the top major flap folder assembly and the structure for mounting said assembly;

FIG. 19 is a timing chart showing the relative positions of various components during a cycle of operation;

FIG. 20 is a diagrammatic illustration of portions of the case pick up, case infeed, and walking stick assemblies; and FIG. 21 is a fragmentary cross sectional view with a vertical intermediate portion broken away, said view being generally taken along the line and in the direction of the arrows 21—21 of FIG. 4 to show the erector vacuum cups in their case erected positions, the rear lower flap folder in its case blank stop-flap folded position and the upper flap folder in its out retracted position, together with a case blank in an erected position.

Figure 2A:
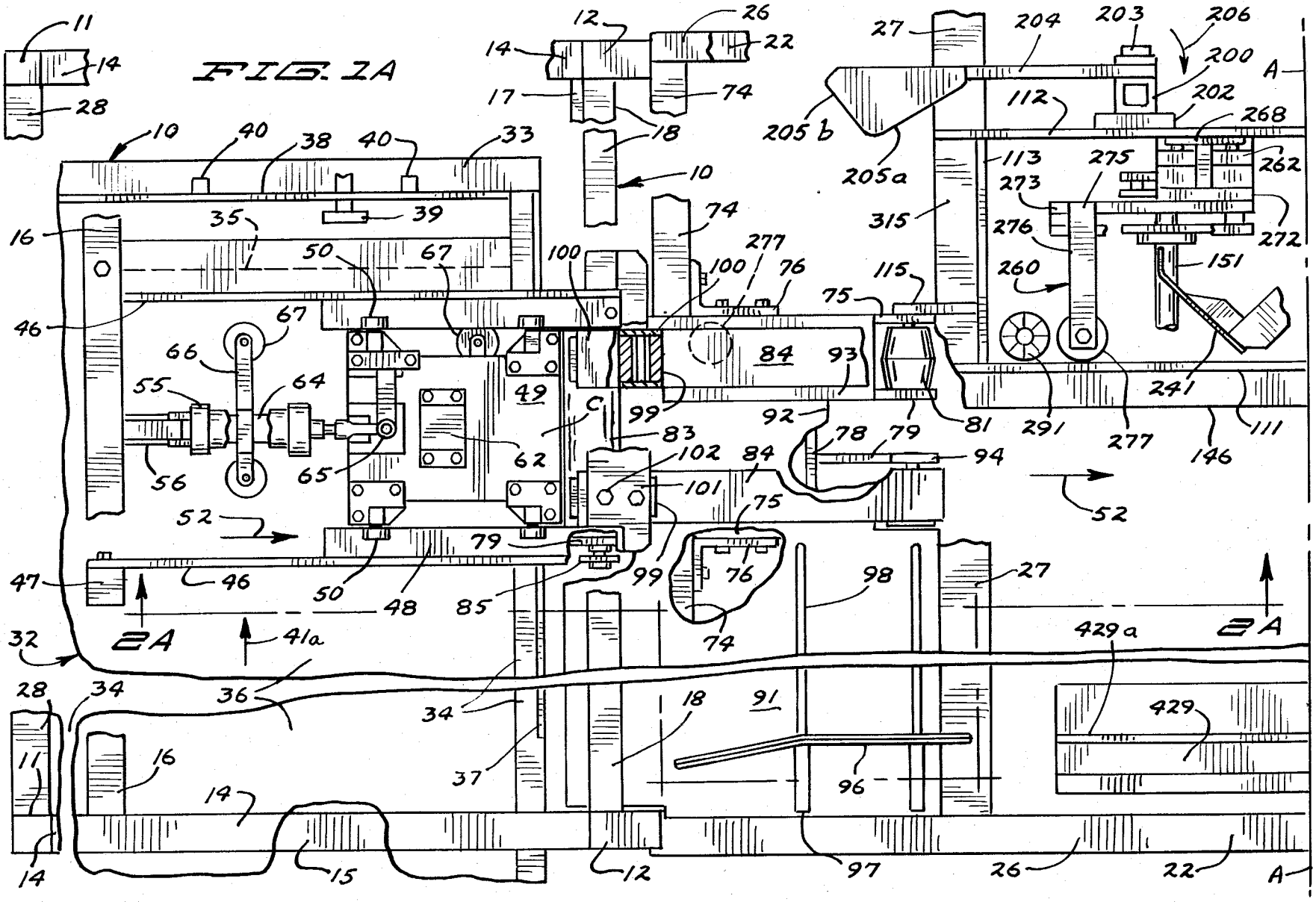
FIGS. 2A and 2B when arranged with lines B—B of FIGS. 2A and 2B aligned form a composite longitudinal vertical sectional view through the apparatus of this invention with various parts broken away and other parts not shown, FIGS. 2A being generally taken along the line and in the direction of the arrows 2A—2A of FIG. 1A and FIG. 2B being generally taken along the line and in the direction of the arrows 2B—2B of FIG. 1B.
Figure 1B:
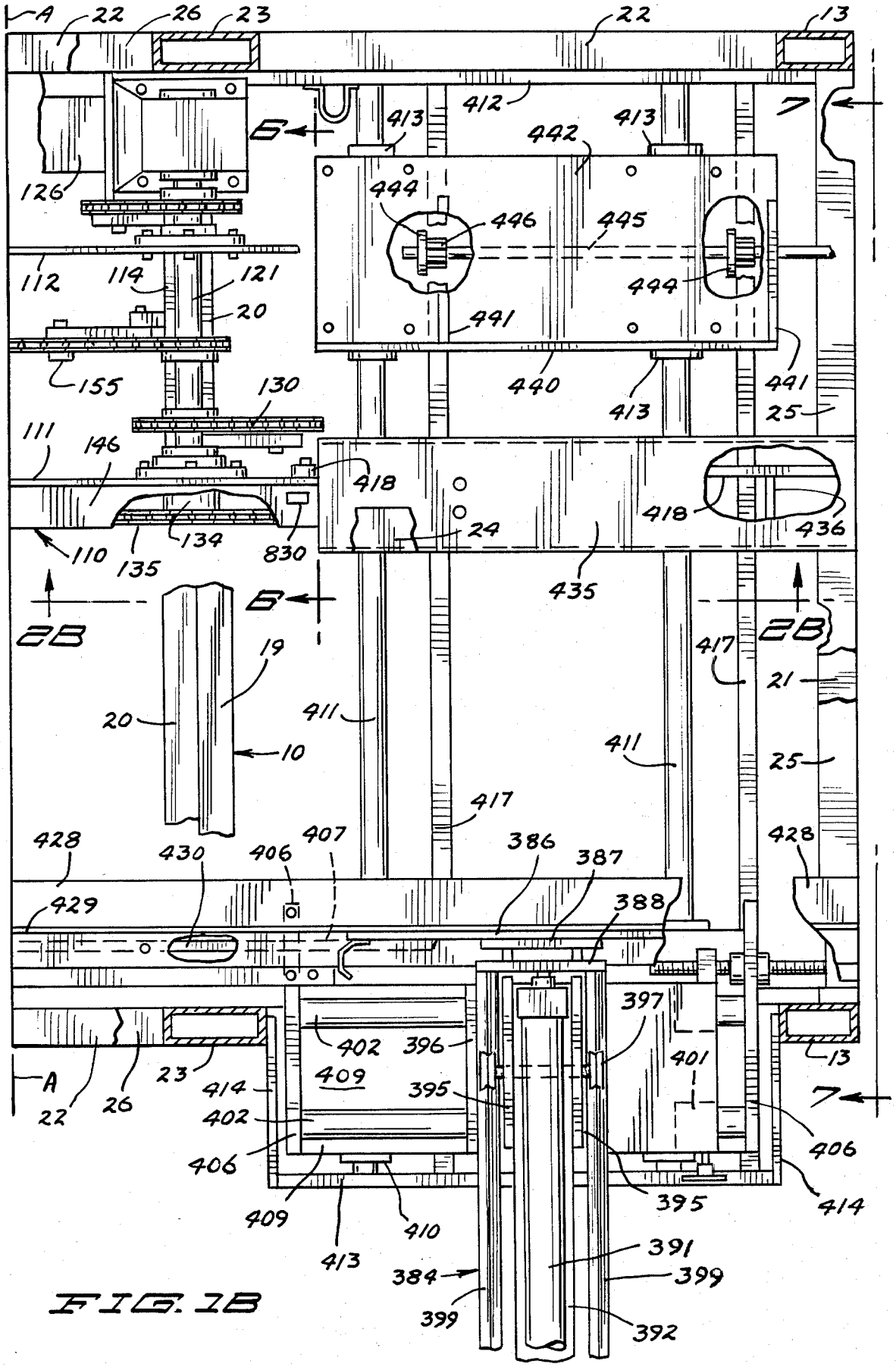

Referring now in particular to FIGS. 1A, 1B, 2A, 2B, and 4, the apparatus of this invention includes a frame, generally designated 10. The frame has rear uprights 11, upper and lower transverse channels 28 extending between and joined to frame members 11, intermediate uprights 12, top longitudinal frame members 14 and lower longitudinal frame member 15 extending between and joined to uprights 11 and 12, a longitudinally intermediate transverse channel 16 extending between and joined to frame members 14, a longitudinally intermediate transverse frame member 17 extending between and joined to uprights 12, a top transverse channel 18 extending between and joined to frame members 12, front uprights 13, lower longitudinal frame members 22 extending between and joined to uprights 12 and 13, a top transverse channel 21 and a lower transverse channel 25 extending between and joined to uprights 13, a transversely intermediate longitudinal channel 24 extending between and joined to channels 18 and 21, vertical frame members 23 mounted on the respective frame member 22 to extend thereabove longitudinally between frame members 12 and 13, a top channel 19 that has one end joined to the upper ends of frame members 23 and has an intermediate portion joined to channel 24, a bottom transverse frame member 20 that extends between and is joined to frame members 23, a bottom frame member 27 rearwardly of frame member 20 that extends between and is joined to channels 22, and upper longitudinal frame members 26 that extend between and are joined to uprights 12 and vertical frame members 23. For feeding case blanks in a flat folded condition with cases stacked vertically one above another there is provided a conveyor (magazine) assembly, generally designated 32, that includes a conveyor frame having transversely elongated frame members 34 and longitudinal frame members 33. A drive roll 35 is mounted by the frame members 34 and is driven by a motor 41. A belt 36 is extended around the drive roll 35 and an idler roll (not shown) that is mounted by the end portions of members 34 remote from the drive roll 35. Advantageously the upper run of the belt 36 is supported by horizontal support plate (not shown) that extends between the drive roll and the idler roll. A vertical guide plate 37 is mounted by the frame member 34 that is adjacent uprights 12 to extend thereabove and along the frame member while a vertical stop plate 38 is mounted by brackets 40 which in turn are mounted on the conveyor frame to be retained in transversely adjusted position by brackets (not shown). The last mentioned brackets are mounted on the frame member 33 that is adjacent to drive roll 35. The stop plate is mounted in position to stop the movement of the stack of case blanks carried by upper run of conveyor belt transversely in the direction of the arrow 41*a* to be at a proper location for being picked up as will be set forth hereinafter. The conveyor assembly may be the same as that described in U.S. Pat. No. 4,133,254 and therefore will not be described in greater detail.

Figures 2A, 3:
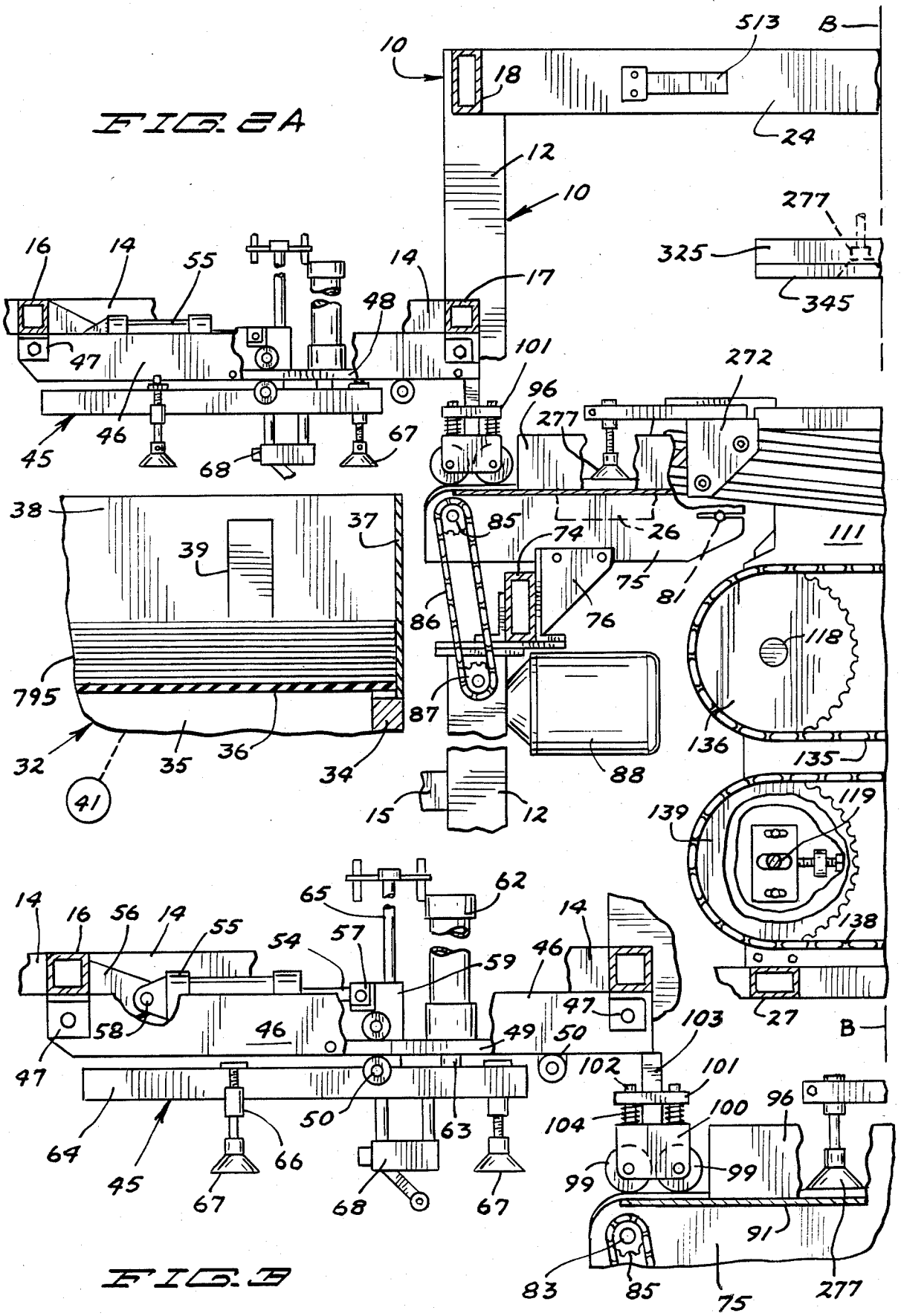
FIG. 3 is an enlarged view of a part of a structure shown in FIG. 2A.

Referring in particular to FIGS. 1A, 2A, and 3, the case pick up and infeed assembly, generally designated 45, includes a pick up assembly that is mounted to be located above one end of the conveyor assembly 32 and includes longitudinal roller track mounts 46. The one ends of the mounts 46 are mounted by brackets 47 to channel 16 while the opposite ends thereof are mounted by brackets to the channel 17. Roller tracks 48 are mounted by mounts 46 to extend transversely toward one another and are longitudinally elongated. A carriage that includes a carriage plate 49 is mounted for reciprocal longitudinal movement (direction of arrow 52 and the opposite direction) by upper and lower rollers 50 that are located to bear against the top and bottom surfaces of the tracks 48. In order to reciprocate the carriage plate, there is provided a cylinder 55 that is pivotally connected at 58 to a bracket 56, bracket 56 in turn being mounted by channel 16. The piston rod 54 of cylinder 55 is pivotally connected at 57 to a guide mount 59 which in turn is mounted on the carriage plate.

An elevating piston-cylinder combination 62, 63 includes a cylinder 62 mounted on the carriage plate to extend thereabove and move therewith, the piston rod 63 of said combination being vertically movably extended through an aperture in said plate and attached to a longitudinally elongated mounting bar 64. A rear vacuum cup mounting cup subassembly 66 is mounted by bar 64 in selected longitudinally adjusted positions and mounts a pair of transversely spaced vacuum cups 67 in depending relation thereto. A front subassembly 66 likewise mounts a pair of vacuum cups 67. A guide rod 65 is attached to bar 64 and is slidably extended through the guide mount 59. The piston-cylinder combination 62, 63 is operable for moving the mounting bar vertically between a position the cups 67 grippingly engage a blank on the top of the stack of blanks on the conveyor assembly 32 that is adjacent to stop plate 38 and an elevated position to be fed forwardly by infeed conveyor mechanism as will be set forth hereinafter. In order to control the amount the vacuum cups are lowered, there is provided a limit switch 68 that is dependingly mounted by the mounting bar 64 with the actuator thereof extending to a slightly lower elevation than the vacuum cups.

The infeed conveyor mechanism for receiving a picked up folded case blank from the pick up assembly and moving it forwardly to the erecting station includes a pair of transversely spaced longitudinally elongated infeed mounting plates 75. Plates 75 are mounted by a bracket 76 which in turn are mounted by a transverse frame member 74 that extends between and is mounted by uprights 12. A transverse plate 78 is mounted by mounting plates 75 intermediate the opposite ends thereof, plate 78 in turn mounting a pair of transversely spaced rear pulley inner plates 79 to extend forwardly thereof. The forward ends of each mounting plate 75 and the adjacent pulley mounting plate 79 mounts adjustment screws (not shown) which in turn mounts a shaft of idler pulley 81 for limited longitudinal adjustment. The rearward ends of the mounting plates 75 rotatably mount a transverse drive pulley 83, transversely spaced endless belts 84 being partially extended around the drive pulley 83 and the respective idler pulley 81. Pulley 83 has a sprocket 85 keyed thereto that is driven by a chain 86 which in turn is driven by a sprocket 87 that is keyed to the output shaft of an infeed motor-reducer combination 88. Combination 88 is mounted by brackets on frame member 74.

An infeed deck 91 is mounted by one of the frame members 26 and the infeed mounting plates 75, the deck having a rearwardly opening notch for part of the drive pulley to extend through, forwardly opening notches for the idler pulleys 81 to extend through, and a forwardly opening notch 92 that extends horizontally further rearwardly of the idler pulley notches for purposes to be described hereinafter. Mounted on the deck adjacent one of the belts 84 is an elongated strip of reflective tape 93 while on one of the pulley mounting plates 79 there is provided a strip of reflective tape 94. The purpose of providing the tape will be set forth hereinafter.

A vertical, generally longitudinal extending case blank infeed guide 96 is mounted by brackets 97 being adjustably secured along the length of notches 98 in the deck by conventional mechanisms (not shown) so that the transverse position of guide 96 relative the belts 84 can be selectively adjusted.

To cooperate with the belts 84 for feeding a picked up case blank forwardly, there is provided two pairs of rollers 99 that are mounted for rotation about horizontal axes. The rollers of each pair are rotatably mounted by the legs of a mounting bracket 100, each bracket 100 being mounted for limited vertical movement relative a cross plate 101 by nuts and bolts 102. Springs 104 are provided on the bolts to act between the bracket webs and the cross plate for constantly resiliently urging the brackets downwardly. As may in part be noted from FIG. 1A, the cross bar mounts the roller mounting brackets so there is one pair of rollers above the rearward part of the upper run of each of the belts 84 to provide entry nips between the rearward rollers and the belts as they go around and above the drive roll 83. A spacer 103 is mounted by the roller track mount 46 for dependingly mounting the cross plate.

Referring in particular to FIGS. 2A, 2B, 4 and 6, a walking stick and drive assembly, generally designated 110, will now be described. The assembly 110 includes a right side plate 111 and a left side plate 112, the side plates being longitudinally elongated and mounted by brackets in transverse spaced relationship on channels 20 and 27 to extend thereabove. A rear cross brace 113 at its opposite ends is secured to the rear vertically intermediate end portions of the side plates while a front cross brace 114 is secured to the front end portions of said side plates. A longitudinal brace 115 is attached to the rear cross brace to extend rearwardly thereof and be attached to the adjacent infeed mounting plate 75.

Mounted for rotation about parallel transverse axes are upper and lower driven shafts 120, 121 respectively that are located at the front ends of the side plates, and upper and lower idler shafts 118, 119 respectively that are mounted by the rear end portions of the side plates. A sprocket 122 is keyed to shaft 120 to be driven by a chain 123 that extends partially around an adjustable tension sprocket 124 that is rotatably mounted on side plate 112 and around a sprocket 125 that is keyed to the output shaft of a motor-reducer combination 126 that is mounted on the frame. A sprocket 129 is keyed to shaft 120 for driving a chain 130 that is extended partially around a tension adjustment sprocket 131 which is mounted by a bracket (not shown) on brace 114 and around a sprocket 132 that is keyed to shaft 121 for driving the last mentioned shaft.

Keyed to shaft 120 is a sprocket 134 for driving a chain 135 that extends partially around an idler sprocket 136 that is keyed to shaft 118. Likewise a sprocket 137 is keyed to shaft 121 for driving a chain 138 that is extended partially around an idler sprocket 139 that is keyed to shaft 119. Sprockets 134, 136, 137 and 139 are located on the opposite side of side plate 111 from plate 112 and are substantially located in a common vertical longitudinal plane.

A walking stick 142 has a lower end pivotally connected at 144 to a link of chain 138 while the intermediate portion of the walking stick is pivotally connected to a link of chain 135 by a pivot member 143. The location of the pivotal connections of the walking stick to the chains and the speed of drive to the chains is such that the walking stick is maintained in a vertical condition at all times; and when the walking stick pivotal connections are located such that as the pivotal connections move along the upper runs of the chains from the idler sprockets toward the sprockets 134, 137, the extension 145 mounted on the walking stick extends above the plane of the top surface of the longitudinal flap guide 146 that is mounted on plate 111. Further, when the walking stick pivotal connections are located along the lower runs of the chains 135, 138 and are moved away from sprockets 134, 137 toward sprockets 136, 139, the top edge of the extension is at a lower elevation than the top surface of the flap guide 146. As may be noted from FIGS. 4 and 6, the flap guide extends substantially the entire length of side plate 111 and has its top surface at the same elevation or higher than the top edge of said side plate. The top surface of the flap guide is at the same elevation or preferably a slightly lower elevation than the top surface of the infeed deck 91. As the pivotal connections of the walking stick are moved from their lower-most elevation to their upper-most elevation (traveling around sprockets 136, 139), the extension on the walking stick is moved upwardly into the notch 92 of the deck 91 to extend a substantial distance above said deck.

Figure 4:
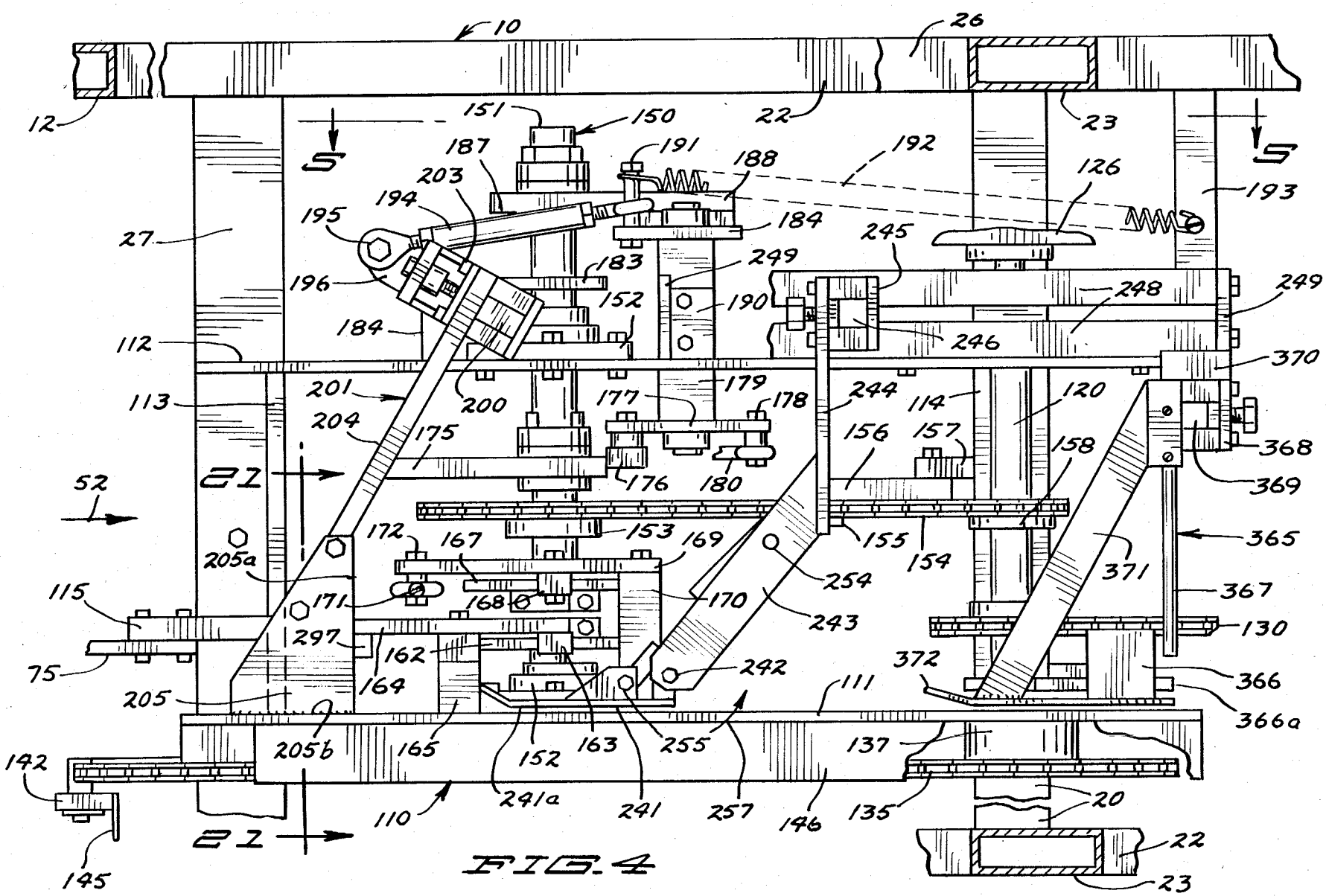
FIG. 4 is an enlarged horizontal view showing the walking stick and drive assembly, the minor flap folder assemblies in flap folded conditions, the cam assembly and the gluing assembly.
Figure 6:
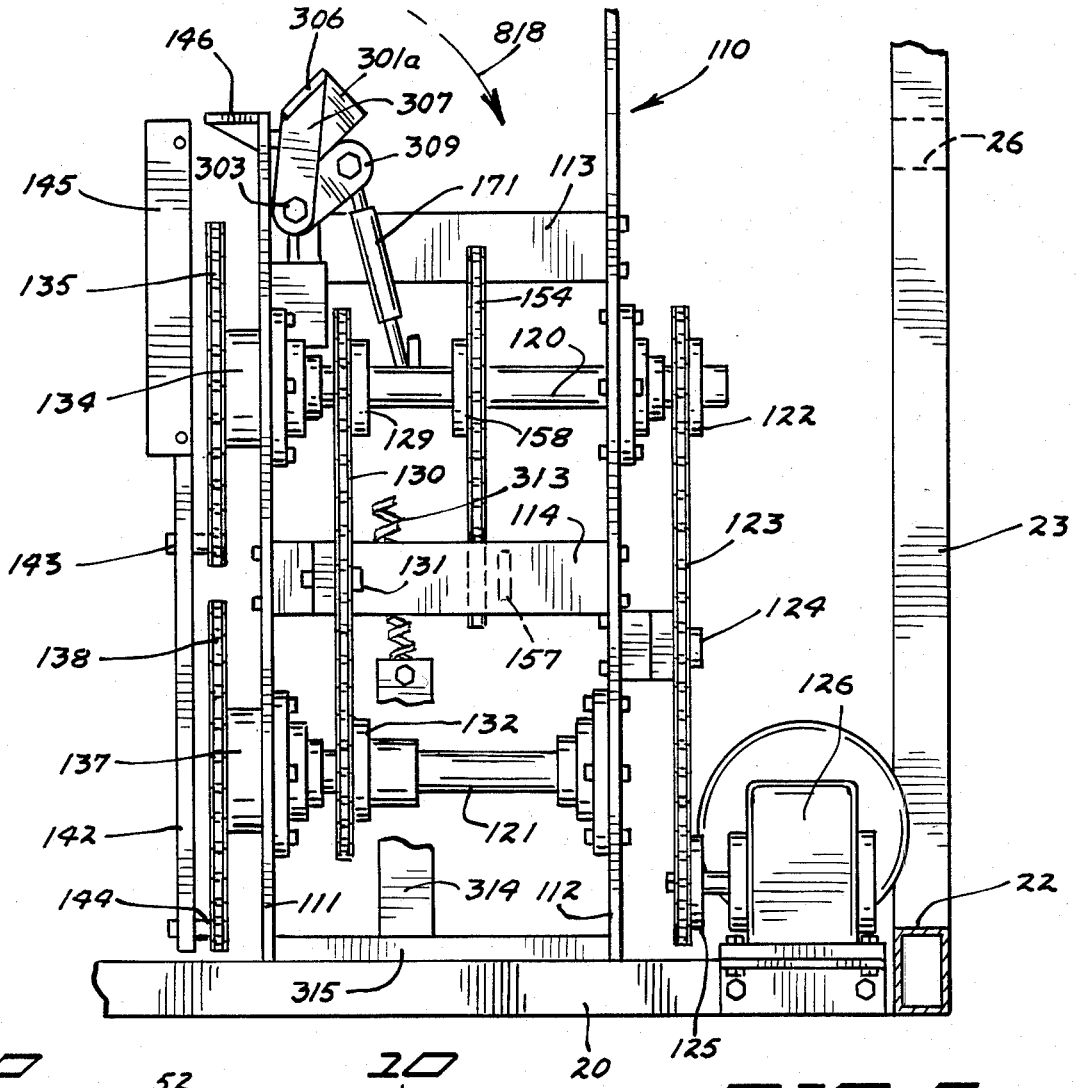
FIG. 6 is a fragmentary transverse view generally taken along the line and in the direction of the arrows 6—6 of FIG. 1B to show the walking stick and drive assembly and a part of the lower major flap folder assembly.
Figure 11:
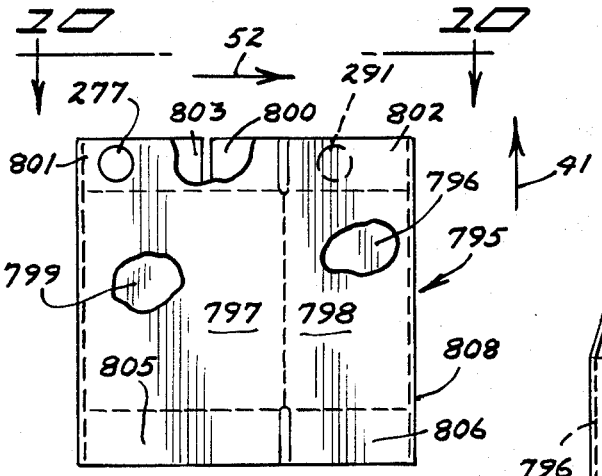
FIG. 11 is a plan view of a case blank in the condition of FIG. 10, together with a showing of the positions the erector cups grippingly engage the folded blank.

Referring now to FIG. 4 and 6, the cam shaft assembly, generally designated 150, will be described. The assembly 150 includes a cam shaft 151 mounted for rotation about a transverse axis by flange bearings 152 that in turn are mounted on the side plates 111, 112. A sprocket 153 is keyed to the cam shaft for being driven by a chain 154 which in turn extends partially around a sprocket 158 keyed to shaft 120 and tension adjustment sprocket 155 that is mounted on an adjustment bracket 156, bracket 156 being mounted by a bracket mount 157 that is secured to cross brace 114.

A lower vacuum cup cam 162 is keyed to the cam shaft for abutting against a cam follower 163. The cam follower is rotatably mounted on one end of cam arm 164, the mid portion of which is pivotally mounted by a mounting member 165. Further, a lower flap folder cam 167 is keyed to the cam shaft for moving a cam follower 168 that is rotatably mounted on the mid portion of a folder arm 169. One end of the folder arm is pivotally mounted on pivot mounting member 170 while the opposite end mounts a pivot member 172 which in turn mounts one end of a rod 171. The pivot mounting members 170, 165 are mounted by the side plate 111.

An erector arm cam 175 is keyed to the cam shaft for moving a cam follower 176 that is rotatably mounted on one end of an arm 177. The mid portion of arm 177 is pivotally mounted by a mounting member 179 that in turn is mounted by side plate 112 while the opposite end of the arm mounts a pivot member 178 which in turn pivotally mounts one end of a rod 180. A switch actuating cam 183 is keyed to the cam shaft for operating the actuator of folder in and erector vacuum off switch 184.

A rear flap tucker cam 187 is keyed to the cam shaft for moving a cam follower 188 that is rotatably mounted by one end of arm 189, the mid portion of the arm being pivotally connected to the side plate 112 by a mounting member 190 while the opposite end portion of the arm mounts the pivot 191.

One end of the coil spring 192 is mounted by pivot member 191 while the opposite end is mounted by an anchor 193 that in turn is mounted by side plate 112 (also see FIG. 5) for constantly resiliently urging the pivot member 191 toward the anchor. Pivot member 191 also pivotally mounts one end of a tie rod 194 which in turn is pivotally connected to one end of an arm 196 by a pivot member 195. The opposite end of arm 196 is fixed to the rectangular, vertically extending shaft 200 of the rear flap tucker, generally designated 201. Shaft 200 is mounted for pivotal movement about a vertical axis by shaft mounts 202 that are in turn mounted on side plates 112 (see FIG. 5).

Figures 5, 8:
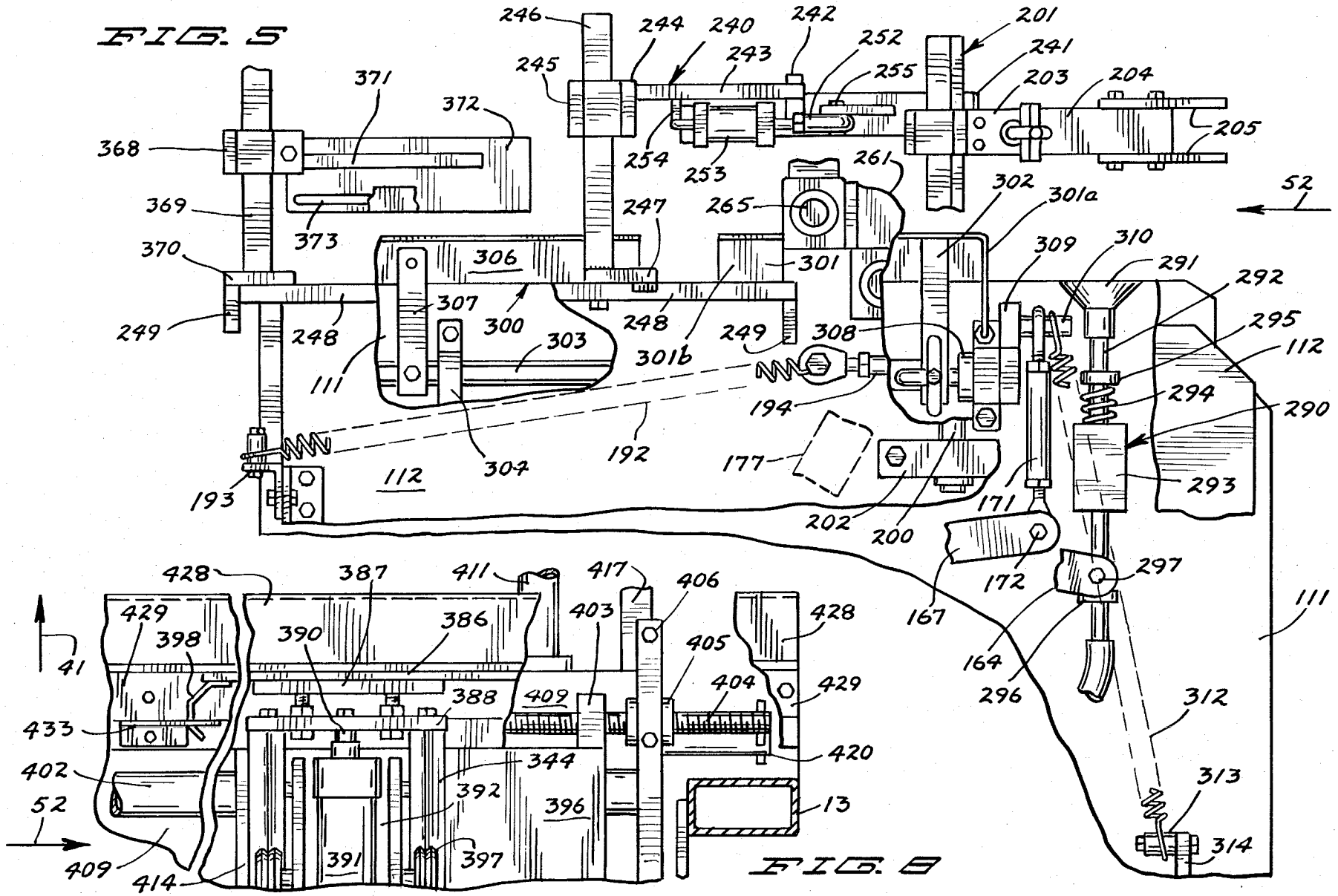
FIG. 5 is a fragmentary enlarged vertical longitudinal sectional view generally taken along the line and in the direction of the arrows 5—5 of FIG. 4 with various parts broken away to in part show some of the structure illustrated in FIG. 4 and to in part show some structure that is not shown in FIG. 4.
FIG. 8 is an enlarged fragmentary horizontal view of a portion of FIG. 1B showing part of the structure for mounting and moving the press plate.

Referring to FIGS. 4 and 5, the rear flap tucker rear minor flap folder assembly 201 also includes a tucker arm 204, one end of which is secured to the rectangular shaft 200 in various select vertically adjusted positions by a clamp mechanism 203. The opposite end of the arm mounts a pair of vertically spaced tucker fingers 205. In FIGS. 4 and 5 the tucker fingers are shown in a minor rear flap tucked (folded) position wherein the edges 205*b* of the tucker fingers extend longitudinally and are substantially in overhanging relationship to the side plate 111 and edges 205*a* extend at right angles to edges 205*b*. In FIG. 1A the tucker fingers are shown in a datum retracted position that for the most part are transversely on the opposite side of side plate 112 from side plate 111. The coil spring 192 through the connections previously described resiliently retain the tucker fingers in the position shown in FIG. 4 while the cam 187 through cam follower and aforementioned connections cause the tucker fingers to be pivotally moved in the direction of arrow 206 about shaft 200 to the retracted position of FIG. 1A, the pivot member 191 being forced upwardly while the fingers are moved from the FIG. 4 to the FIG. 1A position.

Referring again to FIGS. 4 and 5, the front minor flap tucker (folder) assembly, generally designated 240, includes a tucker (folder) 241 that is pivotally connected at 242 to one end of a diagonally extending cylinder mount 243. The opposite end of the cylinder mount is attached to one end of a transversely extending arm 244, the opposite end of the arm being mounted in select horizontal adjusted positions on the vertical adjustment post 246 by clamp mechanism 245. The lower end of the post is fixedly attached to slide mechanism 247, the slide mechanism being mounted for longitudinal adjustment and being retained in an adjusted position on a pair of longitudinally extending slide bars 248. Each of the ends of the slide bars is mounted by a bar mount 249, the bar mounts being mounted on the side plate 112. In order to move the tucker 241 from the retracted position of FIG. 1A to the flap folded (tucked) position of FIG. 4, the piston rod 252 of the piston-cylinder combination 252, 253 is pivotally connected at 255 to the tucker while the cylinder 253 is pivotally connected at 254 to the cylinder mount 243. As the piston rod is moved from its retracted position to its extended position, the tucker is pivoted in the direction of arrow 257 about pivot 242 to a position the elongated vertical surface 241*a* thereof is located parallel to and substantially vertically above side plate 111. As may be noted in FIG. 4, the rear end of the tucker in its flap tucked position is inclined rearwardly and away from the plane of side plate 111 in order to facilitate the movement of the rear minor flap therepast and retain it in a tucked position in case it should be slightly out of a tucked position at that time.

Figure 9:
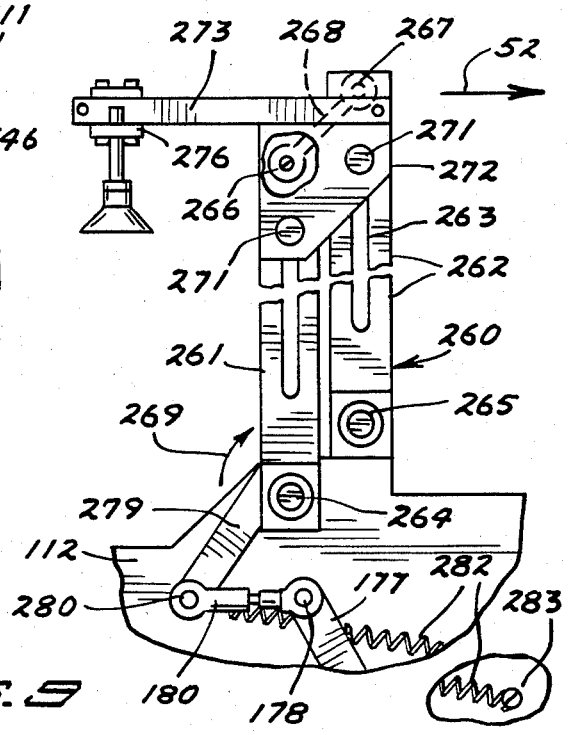
FIG. 9 is an enlarged fragmentary side view showing the upper erector vacuum cup assembly in a case erected condition.

Referring now in particular to FIGS. 1A, 9, and 14, the erector assembly, generally designated 260, includes a pair of elongated arms 261, 262 that are of identical construction. Each of the arms includes an elongated slot 263, one end of arm 261 being pivotally connected to an upwardly projecting portion of side plate 112 by a pivot 264. The corresponding end of arm 262 is pivotally connected to side plate 112 by a pivot member 265, pivot member 265 having a transverse pivot axis at a higher elevation than and forwardly of the pivot axis of pivot 264. The opposite end of arm 261 is pivotally connected at 266 to one end of a link 268, the opposite end of the link being pivotally connected at 267 to the opposite end of arm 262. Pivot axes of pivots 264–267 are parallel to one another and are located such that an arm 261 is pivoted about pivot axis 264, arm 262 is maintained in parallel relationship to arm 261, for example when arm 261 is pivoted in the direction of arrow 269. Each of the arms mount a clamp member 270 to be movable along the length of respective slot 263 and releasably clamped in a selected adjusted position, each clamp member mounting a pivot 271. Pivots 271 pivotally mount a mounting plate 272. Bolted to the mounting plate to be retained in a fixed position relative thereto are a pair of transversely spaced longitudinally elongated arms 273 (with a spacer therebetween) which extend rearwardly of plate 272. The one end of a transversely elongated arm 276 is retained in selected longitudinally adjusted positions relative arms 273 by a clamp member 275. The opposite end of arm 276 dependingly mounts an upper vacuum cup 277.

Pivot members 271 mount plate 277 such that the arms 273, 276 are retained in a horizontal condition as the erector arms 261, 262 are moved from the dotted line upper cup case blank gripping position of FIG. 1A (solid line positions of the arms of FIGS. 2A and 2B) to the solid line case erected position of FIGS. 1A (dotted line position of FIG. 2A) 4,and 9. In order to move the erector arm 261, an arm 279 has one end fixedly secured to arm 261 while the opposite end is pivotally connected at 280 to link 180 which was previously described with reference to the cam shaft assembly. One end of the coil spring 282 is connected to pivot member 280 while the opposite end is connected to a spring mount 283 that in turn is mounted on the side wall 112 longitudinally forwardly of pivot members 264, 265 and at a lower elevation. Spring 282 constantly resiliently urges arm 261 to be pivoted to its solid line folded case blank gripping position of FIG. 2A, cam 175 being rotated to through the cam follower and the linkage previously described pivot arm 261 in the direction of 269 about pivot 264 to the FIG. 9 position.

Referring now to FIG. 5, the lower vacuum cup assembly, generally designated 290, includes a lower vacuum cup 291 that is mounted on the upper end of a tubular cup mount 292. The lower end of the cup mount is fluidly connected to a vacuum tube. The cup mount is mounted for vertical reciprocal movement by a cup mount bracket 293 that in turn is mounted by side plates 111. A coil spring 294 is provided on the tubular cup mount 292 to have the lower end thereof bear against bracket 293 and its opposite end bear against a clamp collar 295 that is mounted on the cup mount whereby the lower vacuum cup is constantly resiliently urged to be at the same elevation or a slightly higher elevation than flap guide 146 (see FIG. 6). A lower clamp collar 296 is mounted on the tubular cup mount 292, a lug 297 mounted on one end of the arm 164 being abuttable against collar 296 for moving collar 296 downwardly and retaining it in a downward position as determined by the configuration of cam 162.

The lower major flap folder assembly, generally designated 300, includes a front flap folder 301 that is generally right angular (see FIGS. 5 and 6). Folder 301 has a front leg 301*a* that extends at right angles to the longitudinally elongated rear leg 301*b*, the upper surface of the rear leg in a flap folded condition extending at an angle, for example 40°, relative side wall 111 with the lower longitudinal edge thereof at substantially the same elevation as the top surface of the flap guide 146 and the top longitudinal edge at a higher elevation and transversely more remote from plate 111 in the direction toward plate 112 than the lower edge. The front leg extends downwardly and toward plate 112 in the flap folded condition. Flap folder 301 is mounted by a bar 302 that in turn is clamped to a longitudinally extending arm shaft 303 in selected longitudinally adjusted position. Shaft 303 is pivotally mounted by mounting brackets 304 that are secured to side wall 111. A generally planar rear flap folder 306 is mounted by a bar 307 to the shaft 303 to extend rearwardly out of the front leg 301*b* and in substantially the same plane as said leg 301*b*. A collar 308 is secured to the shaft to abut against the front mounting bracket 304 while an arm 309 is keyed to the shaft on the other side of said bracket to extend radially away from the shaft. The outer end of arm 309 mounts a longitudinally extending pivot member 310, one end of link 171 being pivotally connected to the pivot member 310 while the opposite end is pivotally connected at 172 to arm 167 as previously described. A coil spring 312 is attached at one end to pivot member 310, the opposite end being mounted by a mounting member 313 that in turn is mounted by the upper end of the spring anchor 314. The spring anchor in turn is mounted by a side plate mount 315 that extends between the front ends of the side plates and is bolted to the channel 27.

Figure 2B:
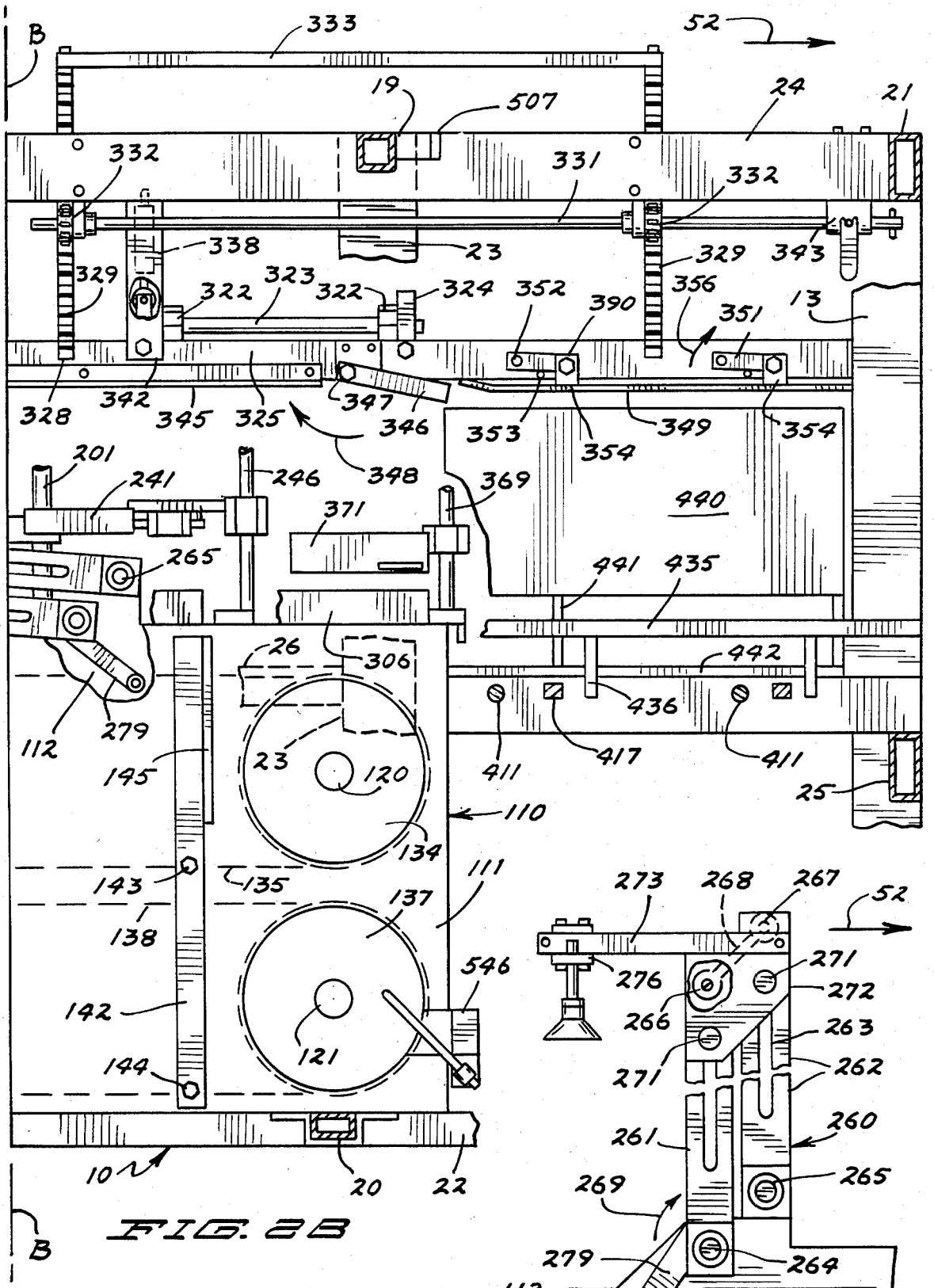
Figures 2, 7:
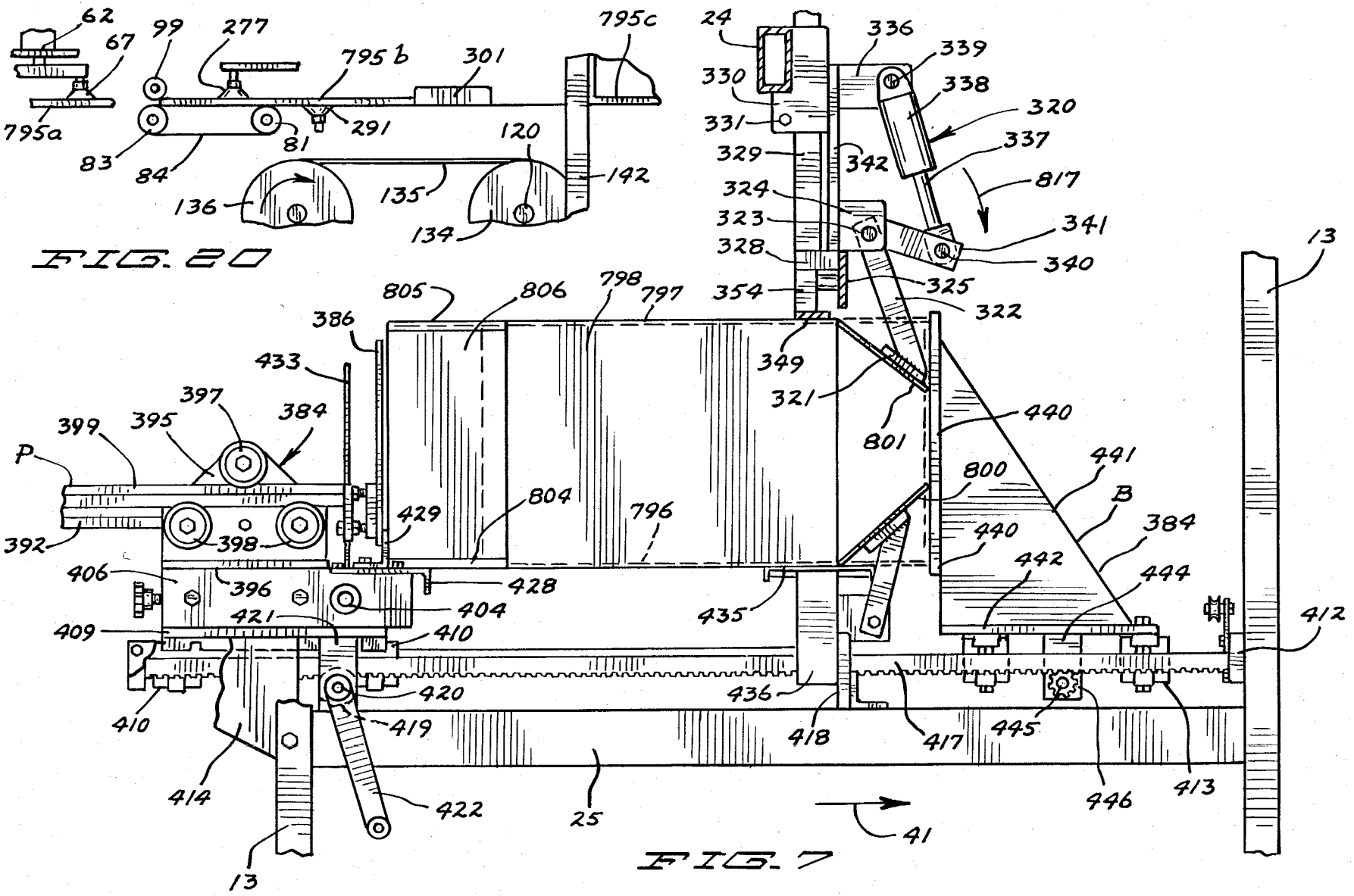
FIG. 7 is a fragmentary front end view generally taken along the line and in the direction of the arrows 7—7 of FIG. 1B showing the compression assembly in a datum condition just prior to the press plate moving into the case shown in solid lines for forming the bottom seal, said view showing the case in dotted lines in a sealed position and additionally showing the upper and lower major flap folder assemblies in a flap folded condition.

Referring now to FIGS. 2B, 7, and 15, the top (upper) flap folder assembly, generally designated 320, includes a top front flap folder 321 mounted by a bar 322 which in turn is secured to a shaft 323 to be pivoted about a longitudinal axis therewith. The shaft is pivotally mounted by shaft mounts 324 that in turn are mounted on a top rail 325. A top flap rear folder 326 is mounted by a bar 322 which in turn is mounted in longitudinally adjusted positions on shaft 323 to pivot therewith, folders 321 and 326 being located in substantially the same plane.

The longitudinally elongated top rail 325 is mounted by supports 328 that in turn are secured to the lower ends of vertical racks 329 to move therewith. The racks are mounted on channel 24 by rack mounts 330 for vertical movement, the rack mounts also rotatably mounting a longitudinally elongated shaft 331. Keyed to shaft 331 are longitudinally spaced pinions 332 that are in engagement with the racks for vertically moving the racks. A brace 333 is attached to the upper end of the racks.

A clamp bracket 343 is mounted by channel 24 for releasably securing the shaft in a given angular direction. A crank (not shown) is provided for rotating the shaft for selectively adjusting the vertical elevation of the racks 329 when the clamp bracket is in an unclamped condition.

In order to move the top flap folders from the flap folded position shown in FIG. 7 to the datum retracted "out" position of FIG. 21, there is provided a piston-cylinder combination 337, 338 that includes a cylinder 338 that is pivotally mounted at 339 to cylinder mount 336. The cylinder mount is mounted by a plate 342 secured to the top rail to extend thereabove and to move therewith. The piston rod 337 is pivotally connected at 340 to one end of an arm 341, the opposite end of the arm being keyed to shaft 323.

A generally horizontal plate 345 has a vertical flange secured to the rearward end portion of the top rail, plate 345 extending on the opposite side of the top rail from top folders and rearwardly of the top rear folder to a location that is longitudinally rearwardly of the front end portion of the side plates for abutting against the top major side wall of an erected case to hold the case down as it is moved forwardly by the walking stick.

The rear end of a squaring bar 346 is pivotally mounted at 347 to the top rail 325 to be located forwardly of the near hold-down plate 345. A pin (not shown) is provided to limit the pivotal movement of the squaring bar in the direction of the arrow 348 to the position shown in FIG. 2B wherein the rear terminal edge of the bottom surface of the squaring bar is located at the same or slightly higher elevation than the bottom surface of the hold-down plate 345 and the front terminal edge of the squaring bar bottom surface is at a substantially lower elevation than the hold-down plate.

A front hold-down plate 349 is located forwardly of the squaring bar, a pair of upwardly extending lugs 354 being mounted on the plate 349. Each of the lugs is pivotally connected at 350 to the front end of an arm 351, the rearward end of each arm being pivotally connected at 352 to the top rail 325. A pin 353 is provided to abut against the under-surface of each of the bars 351 to limit the pivotal movement of the bars 351 about their respective pivot 352 in the direction of the arrow 356 to the position shown in FIG. 2B. In such a position the bottom horizontal surface of the front hold-down plate is at a lower elevation than bottom surface of plate 345 and the bottom rear terminal edge of the squaring bar but at a higher elevation than the bottom front terminal edge of the squaring bar.

Referring to FIGS. 4 and 8, the glue gun (adhesive applicator) assembly 365 is located forwardly of the front tucker assembly. Assembly 365 includes a glue gun 366 having nozzles 366*a* adjacent and vertically above side plate 111 for discharging glue (adhesive) in a direction away from side plate 112. The glue gun is mounted by a transverse rod 367 that in turn is mounted by clamp mechanism 368 to be vertically between the top and bottom major flap folders. The clamp mechanism is releasably retained in selected vertically adjusted position on a post 369, post 369 being mounted on a mount 370 that in turn is mounted by side plate 112.

Figures 17, 18:
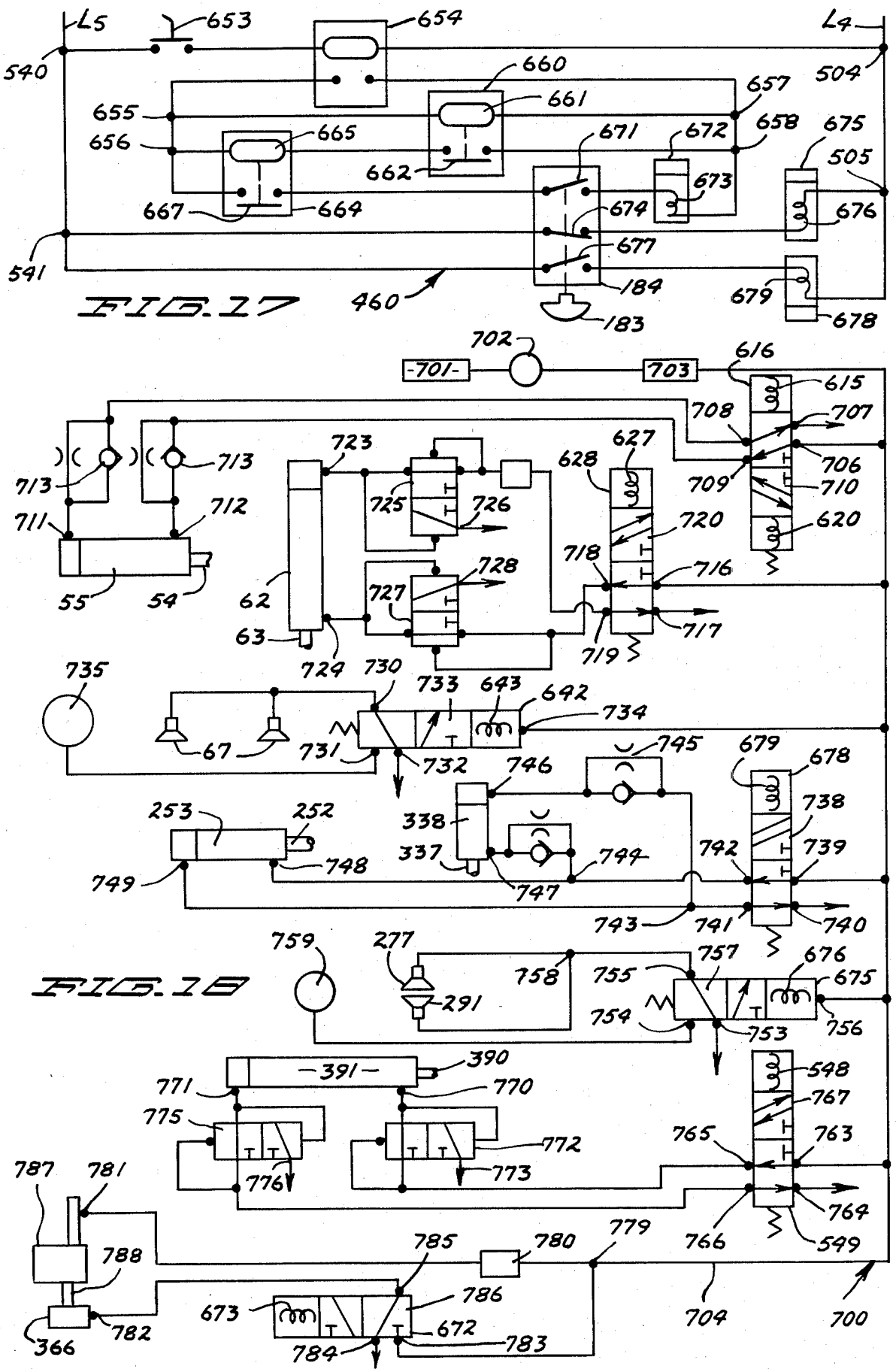
FIG. 18 is a simplified diagrammatic illustration of the pneumatic circuitry and components of the apparatus of this invention.

Also mounted by the clamp mechanism to be vertically adjusted therewith is a fiber optic bracket 371 which mounts a fiber optic mount 372. Mount 372 has a longitudinally elongated slot 373 to mount the sensing end of a fiber optic cable (not shown) that is a part of a conventional photoelectrical scanner unit 660 (FIG. 17). Since a manner of mounting unit 660 and the cable in selected longitudinally adjusted positions along the length of the slot 373 have been described in detail in U.S. patent application Ser. No. 254,997, filed April 16, 1981, (now abandoned), it will not be described in detail in this application. However to the extent necessary to understand the construction and operation of the fiber optic scanner unit and the mounting of the sensing end of the cable, application Ser. No. 254,997 is hereby incorporated by reference. In connection therewith, it is to be noted that the unit 660 controls the spraying of the glue and provides a glue pattern similar to that described in application Ser. No. 254,997.

Referring now in particular to FIGS. 1B, 2B, 7 and 8, the compression assembly, generally designated 384, includes a press plate subassembly P, a back up plate subassembly B and structure for mounting said subassemblies in transversely spaced adjusted position and supporting the erected case blank as the bottom seal is being completed. The compression assembly is at the compression station. The press plate subassembly includes a press plate 386 of a size to be moved horizontally through the top opening of an erected case blank, a squaring bracket 387 being mounted on the press plate. The bracket 387 is bolted to a squaring plate mount 388 which in turn is mounted on a piston rod 390 of a piston-cylinder combination 390, 391 for transversely reciprocating the press plate. The cylinder is mounted on a cylinder mount 392 that in turn extends between and is mounted by longitudinally spaced roller mounting plates 395. The lower edges of the roller mounting plates are mounted by a compression tie plate 396, each roller mounting plate mounting an upper grooved roller 397 and a pair of lower grooved rollers 398 to respectively bear against diagonally opposite corners of a generally rectangular, transversely elongated guide bar 399. Each guide bar at one end is secured to the plate mount 388 to aid in mounting the press plate for translatory movement.

The rectangular tie plate 396 dependingly mounts a pillow block 401 at each corner thereof, the pair of blocks on one transverse side of the tie plate being slidably mounted on a longitudinal guide shaft 402 while the other pair of blocks are likewise mounted on a corresponding guide shaft that is transversely spaced from the first mentioned guide shaft. Slide adjustment brackets 403 are mounted on the tie plate and have internal threads forming a matching fit with the threaded portion of the longitudinally elongated screw shaft 404. The guide shafts 402 and shaft 404 are mounted by shaft mounts 406, the screw shaft being mounted for rotatable movement with clamp collars 405 provided thereon in abutting relationship with one of the guide shaft mounts 406 to retain the screw shaft in a fixed axial position while permitting rotation thereof for moving the brackets 403 and thereby longitudinally moving the compression tie plate and the structure thereon to a selected longitudinally adjusted position. The longitudinally adjusted position and the size and shape of the press plate depend on the size and shape of the erected case top opening.

The guide shaft mounts 406 are mounted on a rectangular bearing mounting plate 409 that at each of its corners dependingly mounts a pillow block 410. The pillow blocks at the front end portion of the mounting plate 409 are slidably mounted on one transverse mounting shaft 411 while the pillow blocks at the rear end portion of the plate are slidably mounted on a second shaft 411. One end of the shafts 411 are mounted by the back-up shaft mount 412 that in turn is mounted by channel 23 and upright 13 while the opposite ends of the shafts are mounted by a compression shaft mount 413. The opposite ends of the shaft mount 413 are mounted by brackets 414, one of the brackets being mounted on upright 13 and the other on the channel 23.

Also mounted by the shaft mounts 412, 413 to extend therebetween are longitudinally spaced transversely extending racks 417, the racks and shafts 411 extending through a longitudinally elongated middle shaft guide 418. One end of guide 418 is mounted by channel 25 while the opposite end is mounted by the upper corner portion of the side plate 111. Pinions 419 are mounted on a longitudinal shaft 420 to have their teeth in intermeshing relationship with racks 417, the shaft being rotatably mounted by shaft mounts 421 that are secured to plate 409 to depend therefrom. A crank 422 is provided for rotating the shaft 420 for selectively adjusting the transverse spacing of plate 409 and the structure mounted thereon from the middle shaft guide 418.

A longitudinally elongated right angular lower flap guide rail 428 has its horizontal leg extending in overlaying relationship to shaft guide mounts 406, the right angular lower flap guide 429 having its horizontal leg in abutting relationship to the top surface of guide rail 428. The horizontal legs in part are bolted to a lower flap guide mount 430 that extends therebeneath and at one end is secured to the rearward shaft mount 406 to extend rearwardly thereof and in part bolted to a rail 407 that extends between and is secured to the shaft guide mounts. Additional bolts are provided for securing the horizontal leg of guide rail to the shaft guide mounts. The vertical leg 429*a* of the lower flap guide 429 has an upwardly opening slot (not shown) of the size for the press plate and the squaring plate 387 to move therethrough. The vertical leg of guide 429 is abuttable against the longitudinal terminal edge of flap 804 and the lower vertical edge portions of flap 806, 807 to limit transverse movement of a case in a direction away from center guide 435. A glue shield 433 is mounted by a bracket on the horizontal leg of the guide rail 428 at a location to extend rearwardly of the press plate, the glue shield being transversely opposite the path of movement of the erected case from the glue gun nozzle.

The lower flap guide rail 428, the lower flap guide 429 and lower flap guide mount 430 extend adjacent to but are sufficiently spaced from the deck 91 to permit transverse adjustment of the press plate subassembly but at the same time to supportingly engage the flap 804 of a case blank as the case blank moves forwardly of the leading transverse edge of the deck. In connection therewith, advantageously the horizontal leg of the lower flap guide rail has a rearwardly and downwardly extending rear end portion (not shown) to aid in movement of the leading transverse edge of a case blank flap 804 onto the guide rail.

Transversely opposite the press plate 386 to extend parallel thereto and of greater vertical and horizontal dimensions than the press plate is a back-up plate 440. The back-up plate is mounted by brackets 441 which in turn are mounted on the horizontal, rectangular mounting plate 442 to extend thereabove. The mounting plate at each corner dependingly mounts a pillow block 413, the blocks 413 being slidably mounted on the transverse shafts 411. The mounting plate also dependingly mounts shaft mounts 444 which in turn rotatably support a longitudinal shaft 445. Shaft 445 has pinions 446 keyed thereto to have the teeth thereof in intermeshing relationship with racks 417. One or more of the pillow blocks for each of the mounting plate 442 and mounting plate 409 may be of a construction for releasably clampingly engaging one or more of the shafts 411 and 402 respectively to retain the mounting plate in the respective adjusted position.

Transversely intermediate the press plate and the back-up plate, there is provided a longitudinally extending center guide 435 that has a rear terminal edge adjacent the front transverse edge of the flap guide 146. The center guide has a top horizontal surface that is at substantially the same elevation as the top surfaces of the flap guide rail 428 and the flap guide 146. The center guide is mounted by depending center guide mounts 436 which in turn are mounted by the middle shaft guide 418 to extend thereabove.

Figure 16:
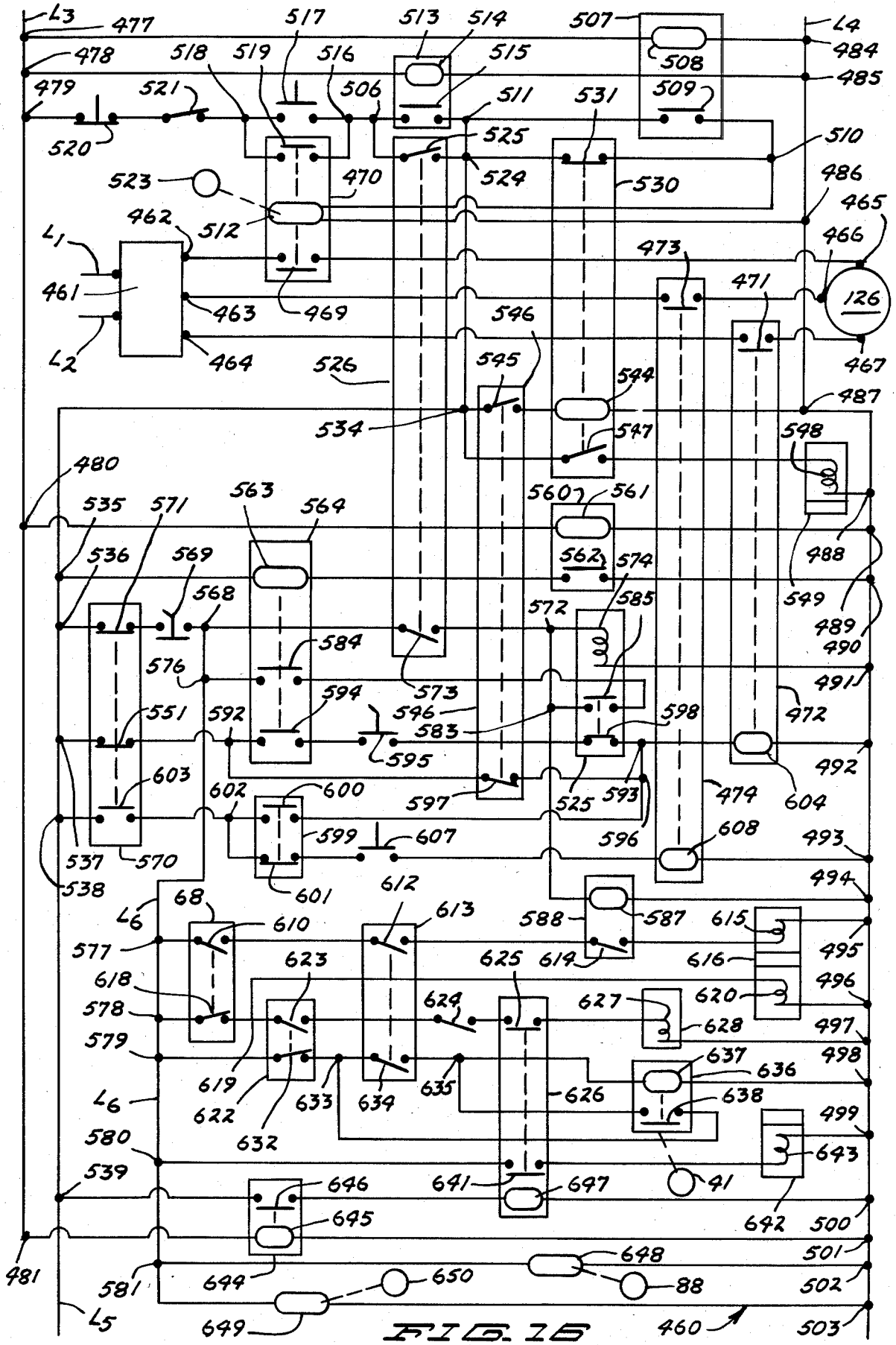
FIGS. 16 and 17 are a simplified schematic illustration of the electric circuitry and components of the apparatus of this invention.

Referring now to FIGS. 16 and 17, the electrical controls and components, generally designated 460, includes a main line $L_1$ and a main line $L_2$ for supplying A.C. power to a DC motor control 461 that provides D.C. power. A normally open switch member 469 of an erector vacuum motor starter relay 470 is connected across terminal 462 of control 461 and terminal 465 of the DC motor 126. A normally open switch member 473 of a reverse drive relay 474 is connected across a second terminal 463 of control 461 and the terminal 466 of the motor 126 while a normally open switch member 471 of a DC motor forward drive relay 472 is connected across terminal 464 of control 461 and terminal 467 of motor 126. When power is applied by lines $L_1$, $L_2$ to control 461 and switch member 473 is closed, the DC motor is driven in a reverse direction while when switch member 473 is open and switch member 471 is closed, the DC motor operates to move the walking stick forwardly through a path of movement to move an erected case forwardly in the direction of arrow 52.

The controls and the components 460 also include main power lines $L_3$ and $L_4$, line $L_3$ having junctions 477–481 thereon while main line $L_4$ has junctions 484–505 thereon.

A jam safety photo switch 507 has a control 508 connected across junctions 477, 484 for operating switch member 509 and maintaining switch 509 in a closed condition while control 508 is energized and a beam of light from the control is reflected back by reflective strip 830 (FIG. 1B) on flap guide 146 to the control, but when the beam of light is broken by a case the switch member is moved to an open condition. Switch member 509 is connected across junctions 510, 511, while the coil 512 of the erector vacuum motor starter relay 470 is connected across junction 510, 486.

The control 514 of the erector safety photo switch 513 is connected across junctions 478, 485, the control 514 when energized and the beam of light from the switch is reflected off of the reflective tape 93 on the deck and back to the switch maintains switch member 515 in a closed condition but when the beam of light impinges on a case between the control and the reflective tape operates switch member 515 to an open condition. Switch member 515 is connected across junctions 506, 511. Junction 506 is connected by a line to junction 516, a push button switch 517 that is resiliently retained in open condition being connected across junctions 516 and 518. Also connected across junctions 516 and 518 is a normally open switch member 519 of the vacuum motor starter relay 470. Connected in series across junctions 518, 479 are limit switches 521 (not shown) that are resiliently retained in an open condition but closed by door panels (not shown) that are provided on the frame for access to various parts of the machine of this invention, and an emergency stop switch 520 that is resiliently retained in a closed position.

A junction 524 is connected by a line to junction 511, a normally closed switch member 525 of the case feed limit switch 526 being connected across junctions 506, 524 while a normally closed switch member 531 of the compression timer relay 530 is connected across junctions 524, 510.

A main line $L_5$ has the above mentioned junctions 511, 524 thereon and additionally has junctions 534–541 thereon. The compression timer relay control 544 and the normally open switch member 545 of the case-in-position limit switch 546 are connected in series across junctions 534, 487 while the normally open switch member 547 of the timer relay 530 and the solenoid coil 548 of the compression cylinder pneumatic control valve 549 are connected in series across junctions 534, 488.

A case-in-position photo switch 560 has its control 561 connected across junctions 480, 489, the photo switch retaining its switch member 562 in a closed position as long as control 561 is energized and its beam of light is reflected back from the reflective tape 93 (see FIG. 1A) to the photo switch but operates the switch member 562 to an open condition when the beam of light is interrupted by impinging on a case blank. Switch member 562 and the solenoid coil 563 of the case-in-position relay 564 are connected in series across junctions 535, 490. A switch member 571 of the run-jog switch 570 and the case feed on/off switch 569 are connected in series across junctions 536, 568. Switch 569 is of a type that remains in "on" position once it has been moved thereto and when moved to an "off" position remains in the off position. Normally open switch member 573 of limit switch 526 is connected across junctions 568, 572, the solenoid coil 574 of the case feed relay 575 being connected across junctions 572, 491. A line $L_6$ is connected to junction 568 and has junctions 577–581 thereon. Normally open switch member 584 of the case-in-position relay 564 and the normally open switch member 585 of the case feed relay 575 are connected in series across junctions 576, 583. Junction 583 is connected by a line to junction 572. The control 587 of the case feed timer 588 is connected across junctions 583, 494. The switch member 551 of the run-jog switch 570 is connected across junctions 537, 592 while the normally closed switch member 597 of the case-in-position limit switch 546 is connected across junctions 593, 596. Junction 596 is connected by a line to junction 593 while connected in series across junctions 593, 592 are the normally open switch member 594 of the case-in-position relay 564, the manual-automatic switch 595 which remains in either an "on" or an "off" position depending upon the position it was last moved to, and a normally closed switch member 598 of the case feed relay 575. The solenoid coil 604 of the DC motor reverse switch 472 is connected across junction 593, 492.

A switch member 603 of the run-jog switch 570 is connected across junctions 538, 602, switch 570 being of the type that in the run position switch members 571, 551 will remain closed and switch members 603 will remain open and when manually moved to a jog position switch members 571, 551 will remain open and switch member 603 will remain closed until the switch is again operated to a run condition. Connected across junctions 602 and 596 is a normally open switch member 600 of the push button jog forward switch 599, junction 596 being connected by a line to junction 593. Connected in series across junction 602 and 493 is the normally closed switch member 601 of switch 599, a jog reverse switch 607 which is resiliently retained in an open condition, and the solenoid coil 608 of the DC motor reverse relay 474. Switch 599 is of a type that is resiliently retained in a position switch member 600 remains open and switch member 601 remains closed but when and as long as it is manually depressed switch member 600 is closed and switch member 601 is open.

Connected in series across junctions 577, 495 is the normally open switch member 610 of the case pick-up limit switch 68, the normally open switch member 612 of the pick-up limit limit switch 613, switch 614 of the timer relay 588, and the solenoid coil 615 of the pneumatic case feed valve 616 for controlling the application of air to the case feed cylinder 55. Valve 616 also includes a solenoid coil 620 that is connected across junctions 496, 619 while the case pick-up relay 68 includes a normally closed switch member 618 that is connected across junctions 578, 619. Connected in series across junctions 619, 497 is the normally open switch member 623 of the case-in-magazine relay 622, a pick-up back limit switch 624 that is resiliently retained in an open position, the normally open switch member 625 of the case infeed relay 626, and the solenoid coil 627 of pneumatic pick-up down cylinder control valve 628. Limit switch 622 also includes a normally closed switch member 632 that is connected across junctions 579, 633, the normally open switch member 634 of the pick-up up limit switch 613 being connected across junctions 633, 635. Switch member 638 of the magazine motor starter 636 is connected across junctions 635, 633 while the coil 637 is connected across junctions 635, 498. When coil 637 is energized, switch member 638 is moved to and retained in a closed position while when the coil is deenergized switch member 538 is open. The starter relay 636 also includes switch members (not shown) that are moved to a closed position when coil 637 is energized for energizing the magazine motor 41 through electric circuit (not shown).

Connected in series across junctions 580, 499, are the normally open switch member 641 of the case infeed relay 626 and the solenoid coil 643 of the pneumatic pick-up vacuum control valve 642. Connected in series across junctions 539, 500 is the solenoid coil 647 of the relay 626 and the switch member 646 of the case infeed photo switch 644. Switch 644 also includes a control 645 that is connected across junctions 481, 501. As long as the control 645 is energized and no case blank is adjacent thereto, switch member 646 remains in a closed position, however when a case blank is moved adjacent thereto, switch member 646 is open and remains in an open condition. Switch 644 is of a proximity type switch of a conventional nature which will operate switch member 646 to an open condition upon a case blank moved within a preselected distance of said switch. The solenoid coil of the feed-motor-starter relay 648 is connected across junctions 581, 502, the relay which, when energized through appropriate electric circuitry (not shown) will energize the feed motor 88. Further, a starter relay 649 has its coil connected across junctions 581, 503 which, when energized, through appropriate electric circuitry (not shown) will energize the pick-up vacuum motor 650.

Referring to FIG. 17, connected in series across junctions 540, 504, is a glue on/off switch 653 that remains in the position it is set in, and the input terminals for the D.C. power supply 654. The power supply has D.C. output terminals, one of which is connected to junctions 655 and the 656 while the output terminal is connected to junctions 657, 658. The voltage at the output terminals is of a low D.C. voltage suitable for operating a fiber optic scanner 660 which advantageously may be of a construction described in greater detail in U.S. patent application Ser. No. 254,997, filed April 16, 1981. The application Ser. No 254,997 is incorporated by reference to extent necessary to understand the control circuitry for controlling the operation of the glue gun. The fiber optic control 661 of scanner 660 is connected across junctions 655, 657 and when an erected case blank is in sufficiently close proximity to the terminal end of the scanner-emiter-receiver cable (not shown) operates switch 662 to a closed position and when it has passed the terminal end switch member 662 returns to an open position as described in the aforementioned application. The cable has it terminal end portion mounted to extend within slot 373 of the mounting bracket 372 to sense the presence of folded minor case flaps as said flaps move therepast. Switch member 662 together with the solenoid coil 665 of the glue relay 664 are connected in series across junctions 656, 658. Also connected in series across junctions 656, 658 are the normally open switch member 667 of the relay 664, switch member 671 of the cam operated switch 184, and solenoid coil 673 of the glue control valve 672. Switch 184 also includes a switch member 674 that together with solenoid coil 676 of the erector vacuum pneumatic valve 675 are connected in series across junctions 541, 505. Also connected in series across the last mentioned junctions are the switch member 677 of the cam operated switch 184 and the solenoid coil 679 of the front minor and top major flap control valve 678. Limit switch 184 is operated by cam 183 and is of a type that when switch members 671, 677 are open, switch member 674 is closed, and when switch 674 is open, switch members 671, 677 are closed.

Referring now to FIG. 18, the pneumatic circuitry, generally designated 700, includes a source of fluid (air) under pressure 701 that is connected through an on-off valve 702 and a pressure regulator 703 to pressure line 704. The case infeed valve 616 has an inlet port 706 connected to line 704, an exhaust port 707, a port 708, a port 709 and a valve member 710 that after coil 615 has been energized fluidly connects port 708 to port 707 and port 709 to port 706 and remains in said condition, even though coil 615 is deenergized, until coil 620 has been energized. When coil 620 has been energized, port 706 is connected to port 708 and port 709 is connected to the exhaust port and the valve member remains in such condition even after coil 620 has been deenergized up until coil 615 is energized. A flow restrictor-check valve combination 713 are connected in parallel between port 708 and port 711 on the case infeed cylinder 55 while a corresponding flow restrictor-check valve combination is likewise fluidly connected in parallel between port 712 on cylinder 55 and port 709. The check valves are oriented such to block flow of air exhausting from the cylinder therethrough but to permit air under pressure flowing to the respective cylinder ports to flow therethrough.

The inlet port 716 of the pick-up cylinder control valve 628 is connected to pressure line 704, valve 628 also having an exhaust port 717, a port 718, a port 719 and a valve member 720 that is resiliently retained in a position to fluidly connect port 718 to port 716 and port 719 to port 717. However when the solenoid coil 627 is energized the valve member moves to fluidly connect port 718 to port 717 and port 719 to port 716. Connected in series across port 718 and port 724 of the pick-up cylinder 62 are a flow regulator and a quick release valve 727 that has an exhaust port 728. When air under pressure is flowing in a direction from port 718 to cylinder 62, the valve member of valve 727 provides a fluid flow path therethrough to port 724 and blocks the exhaust port 728. However, when port 718 is connected to the exhaust port 717 and there is air under pressure in the cylinder at port 724, the air under pressure operates the valve member to move to a position to fluidly connect port 724 to the valve exhaust port 728 until the pressurized air is exhausted from port end 724 of the cylinder. A quick release valve 725 is connected across port 719 and port 723 of cylinder 62, the quick release valve having exhaust port 726 and operating in the same manner described with reference to release valve 727.

The case pick-up vacuum control valve 642 has a valve pilot port 734 connected to the pressure line 704, a port 730 that is connected by lines to vacuum cups 67, a port 731 that is connected to vacuum pump 735 (driven by motor 650), an exhaust port 732 and a valve member 733. Valve 642 is of a construction that when no air under pressure is applied at port 734, and/or coil 643 is deenergized, port 730 is fluidly connected to port 732 but when air under pressure is applied to port 734 and coil 643 is energized port 730 is fluidly connected to port 731.

The inlet port 739 of the minor flap tucker and top major flap folder control valve 678 is fluidly connected to the pressure line 704, valve 678 having an exhaust port 740, a port 741, a port 742, and a valve member 738 that is resiliently retained in a position to fluidly connect port 741 to the exhaust port and port 742 to port 739, but when energized fluidly connects port 741 to port 739 and port 742 to port 740. Port 741 is connected to a junction 743, a check valve-flow restrictor combination 745 being connected across port 743 and port 746 of the top major flap folder cylinder 338. The opposite end of the cylinder has a port 747, a flow restrictor-check valve combination 745 being connected across port 747 and junctions 744 which in turn is fluidly connected to port 742. The check valves are oriented to permit air flow therethrough from the valve toward the respective cylinder port but block air flow from the respective cylinder port through the valve. Junction 744 is also fluidly connected to port 748 of the minor flap tucker cylinder 253, cylinder 253 having a port 749 that is fluidly connected to junction 743.

The erector control valve 675 is of the same construction and operates in the same manner as valve 642, valve 675 having a valve member 757, a pilot port 756 fluidly connected to pressure line 704, an exhaust port 753, a port 755 which is connected to a junction 758 that in turn is connected to the upper and lower vacuum cups 277, 291, and a port 754 that is fluidly connected to an erector vacuum pump 759 which is driven by motor 523.

The inlet port 763 of the compression cylinder control valve 549 is fluidly connected to pressure line 704, valve 549 having an exhaust port 764, a port 765, a port 766 and a valve member 767 that is resiliently retained in a position to fluidly connect port 763 to port 765 and port 764 to port 766. However when the solenoid coil 548 is energized, port 765 is fluidly connected to port 764 and port 763 is fluidly connected to port 766. A quick release valve 772 is connected across port 765 and a port 770 of the compression cylinder, valve 772 having exhaust port 773. The cylinder 391 has a port 771 on the opposite end thereof, a quick release valve 775 which has an exhaust port 776 being connected across ports 771, 766. The quick release valves 772 and 775 operate in the same manner described with reference to quick release valve 727.

Pressure regulator 780 is fluidly connected across port 781 of hot melt adhesive unit 787 and a junction 779 on the pressure line 704 while a port 782 on the glue gun 366 is fluidly connected to port 785 of the glue gun control valve 672. A hose 788 conducts hot adhesive from unit 787 to the glue gun. Valve 672 also has an inlet port 783 that is fluidly connected to junction 779, an exhaust port 784 and a valve member 786 that is resiliently retained in a position fluidly connecting port 785 to port 784 but when coil 673 is energized, fluidly connects port 783 to port 785. When air under pressure is applied at port 782, the glue gun will discharge glue through its nozzles to be sprayed on the adjacent minor flaps as will be referred to hereinafter.

Before describing the operation of the apparatus of this invention, it is to be mentioned that it is to be used for opening and sealing the one ends of case blanks 795 of the type illustrated in FIGS. 10–13. That is, each case blank in a flat folded condition has major side walls 796, 797 and minor side walls 798, 799 that are joined at contiguous edges to the major side walls at fold lines. The one ends of the side walls 796 and 797 respectively have the one ends of major flaps 804 and 805 joined thereto to be folded at fold lines while the opposite ends of said side walls have major flaps 800 and 801 joined thereto to be folded along fold lines. The opposite ends of minor side wall 798 has minor flaps 802 and 806 respectively joined thereto along fold lines while the minor side wall 799 has minor flaps 803 and 807 joined thereto to be folded along fold lines. When the case blanks 795 are in a flat, folded condition in vertical stacked relationship on the conveyor assembly 32, the walls 797, 798 and flaps 801, 802, 805, and 806 lie substantially in a common plane and are located above walls 796, 799 and flaps 800, 803, 804, and 807 other than where side wall 798 is joined to side wall 796 and side wall 797 is joined to side wall 799. Additionally, the case blanks are stacked on conveyor belt 36 such that the juncture 808 of side walls 798, 796 are in abutting relationship to or closely adjacent to guide plate 37 while the stacks are conveyed by the conveyor belt 36 in the direction of the arrows 41 to a point the terminal edges of flaps 800–803 are closely adjacent to stop plate 38 and the terminal edges of at least some of said flaps abut against the actuator plate 39 to operate the case-in-magazine limit switch 622.

For purposes of describing the operation of the apparatus of this invention, it will be assumed that no electrical power is being applied to lines $L_1$–$L_4$, that valve 702 is closed so that no air under pressure is being applied through regulator 703 to line 704 and that there are a plurality of horizontally spaced vertical stacks of case blanks on the conveyor belt 36 with the case blanks in each stack in face to face relationship and oriented in the same direction but that no stacks of blanks abuts against actuator 39 (or extend at least in part below one of the cups 67) and accordingly the case-in-magazine limit switch 622 has switch member 632 closed and switch member 623 open to prevent the pickup down cylinder valve 628 being engaged, and that no case blank, erected or otherwise, is in the machine forwardly of the conveyor assembly 32. Now upon opening valve 702 air under pressure is applied to line 704. Since all the valve solenoid coils are deenergized air under pressure is applied to whichever end of the case infeed cylinder 55 that it had last been applied to when the machine had been turned off, air under pressure is applied through valve 628 and the quick release valve 727 to the lower end of the pickup cylinder 62 which results in the pickup cups 67, including mounting bar 64, being moved to an elevated position. Mounting bar 64 in being moved to an elevated position closes the switch members of the pickup up limit switch 613 that were being resiliently retained in an open condition. Also air under pressure is applied to port 734 of the pickup vacuum control valve 642, but no vacuum is applied to cup 67 at this time since neither coil 643 nor the vacuum pump motor is energized. Additionally, air under pressure is applied to ports 747 and 748 of cylinders 338 and 253 respectively for moving the upper major flap folder 321 from the folded position shown in FIG. 7 to an elevated position of FIG. 21 to be above the top major flap of the case blank that will be subsequently passed therebeneath and the front minor flap tucker 241 from its flap tucked position of FIG. 4 to its retracted position of FIG. 1A. The check valve-flow restrictor combinations 745 delay the movement of the major flap folders to their flap folded condition until after the front minor tucker has moved to its tucked "in" position. Additionally, air under pressure is applied at port 756 of the erector control valve 675. Valve 675 operates in the same manner as valve 642. Further, air under pressure is applied through valve 549 to port 770 of the compression cylinder 391 to move the press plate to its retracted position remote from the backup plate, while air under pressure is applied to port 781 of the adhesive unit 787 and to port 783 of the glue control valve 786 which is resiliently retained in a position to connect the glue gun port 782 to exhaust port 784.

Now electric power is applied to line $L_1$ and $L_2$. However the DC motor 126 is not energized at this time since the motor-starter relay switch member 469 is in an open condition, the line in which switch member 469 is located being the common line for both forward and reverse drive of the motor. For automatic operation the run-jog switch 570 is positioned in its automatic position whereby its switch members 571, 551 are in a closed position and switch member 603 is open, the manual automatic switch 595 is moved to a closed position for automatic operation, glue on and off switch 653 is moved to a closed position and limit switches 521 are closed due to door panels (not shown) being closed. The application of power across lines $L_3$, $L_4$ results in the control members of the photo switches moving their switch members 515, 509, 646, and 562 to closed positions. With switch members 515, 509 closed, upon temporarily depressing the on/off switch 517 the circuit is completed for energizing the DC motor-starter coil 512 to move its switch member 519 to a closed position to form a hold-in circuit even though thereafter switch member 517 resiliently returns to an open position. At the same time, due to power now being applied at junction 511, main line $L_5$, is energized, and since switch 571 and 569 are closed power is also supplied across main line $L_6$. This results in the pickup vacuum motor-relay 649 and the case feed-in motor relay 648 being operated to respectively apply power to motors 650, 88 and the magazine motor starter relay 636 being energized to energize magazine motor 41 and close switch member 638 to maintain the magazine motor energized even though switch member 634 subsequently moves to an open position. Upon the upper run of the conveyor belt 36 being driven in the direction of arrow **41*a* by the magazine motor to a position the advance stack of case blanks on said belt abut against actuator 38, switch member 632 of the case-in-magazine limit switch 622 is moved to an open condition to denergize the magazine motor and switch member 623** is closed.

Since photoswitch member 646 of the case infeed photoswitch is closed, coil 647 of the case infeed relay 626 is energized to close switch members 625, 641. The closing of switch member 641 energizes the pickup vacuum valve 642 so that its valve member moves to apply a vacuum to pick up cups 67. As long as the actuator on the case pickup limit switch 68 does not contact a case blank, switch member 618 remains closed and accordingly the case feed-in coil 620 of valve 616 is energized. As a result, if the valve member 710 is not in such a position, it is moved by the energization of coil 620 to fluidly connect port 706 to port 709 and thereby apply air under pressure to port 712 of the case feed cylinder 55 for retracting (moving in the direction opposite arrow 52) the carriage plate 49 and the structure mounted thereon to be more remote from the conveyor infeed assembly. When the carriage plate is in its retracted position, it engages the pickup back limit switch 624 to move it to a closed position, and now a circuit is completed to energize the solenoid coil of the pickup down valve 628. As a result, valve member 720 is moved to fluidly connect port 716 to port 719 and through the quick release valve 725 apply air under pressure through port 723 to the upper end of the pickup cylinder 62. The air in the lower end of the cylinder exhausts through port 724 and operates release valve 727 so that the air exhausts through port 728. Upon the vacuum mounting bar 64 being lowered sufficiently that the actuator on limit switch 68 contacts the top case blank on the stack of case blanks therebeneath, its switch member 618 is moved to an open condition and switch member 610 is moved to a closed condition. Even though the actuator extends to a lower elevation than the cups 67, the time delay in reversing the direction of movement of the piston rod 63 is sufficient that the cups 67 grippingly engage the top case blank. Switch member 618 in opening breaks the circuit for energizing the solenoid coil 620 of the case feed valve 616 and the pickup down valve 628. As a result, valve member 720 moves to apply air under pressure from port 716 to port 718 and through the quick release valve 727 to port 724 to start the elevation of the mounting bar 64 and the vacuum cups mounted thereon. At the time the mounting bar had started its downward movement, it moved out of engagement with the actuator of the pickup up limit switch 613 and as a result switch members 612, 634 resiliently moved to an open condition. Upon the mounting bar again being moved to its elevated condition, it engages the actuator of the pickup up limit switch 613 and as a result closes switch member 612, 634. However, at this time the case feed in solenoid coil 615 is not energized since switch member 614 of the case feed timer 588 is in an open condition.

In the event that the pickup cups did not pick up a case blank, as the elevating bar moves upwardly switch member 618 moves to a closed position to again energize the pickup down valve to apply air under pressure to cylinder 62 to move the elevating bar 64 downwardly to move the cups 67 to contact the top case blank on the vertical stack of blanks.

Figure 10:
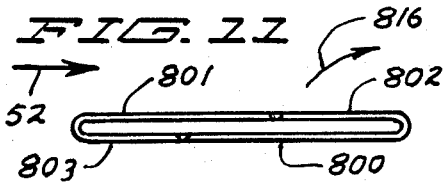
FIG. 10 is an end view of a case blank in a flat folded condition, said view being generally taken along the line and in the direction of the arrows 10—10 of FIG. 11.
Figure 13:
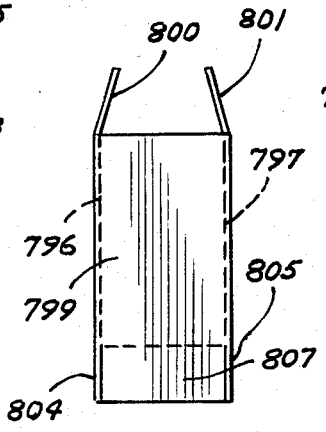
FIG. 13 is a side view of a case blank in the condition illustrated in FIG. 12.

For purposes of further describing the operation of the apparatus of this invention, it will be assumed that case blank 795*a* has been elevated by cups 67 in the manner previously described and in the condition illustrated in FIG. 10, that a flat, folded case blank 795*b* is on case infeed conveyor and at the erecting station with the advanced transverse edges of flaps 802, 800 in abutting relationship to leg 301*a* of the bottom major flap folder in its bottom flap folded condition, and the blank extends rearwardly of leg 301*a*, the erector upper and lower vacuum cups having vacuum applied thereto just engaging flaps 801 and 800 respectively of case blank 795*b* with the lower cup top edge above flap guide 146, and that the walking stick has just pushed an erected case blank 795*c* to the forwardmost position that it pushes a case blank. Further, at least the advanced portions of the fold lines of flaps 800, 802 of blanks 795*b* are above and vertically aligned with side wall 111 or transversely closely adjacent to being vertically aligned with said side wall, that at least part of flap 800 is being supported by flap guide 146, that at least part of flap 804 is being supported by guide rail 428 and that at least part of blank 795*b* is being supported by belts 84 and deck 91 with terminal edge portions of some of its flaps abutting against the longitudinal forward part of guide 96 and the vertical leg 429*a* of the lower flap guide rail 429.

At the forwardmost point of movement of the walking stick, it has pushed a case blank against which it abuts so that the trailing portion of the blank is located immediately rearwardly of the rear transverse edge of the center guide 435 while a piece of reflective tape 830 mounted on flap guide 146 extends forwardly to a point just rearwardly of the trailing vertical surface of the case blank on guide 435 so as to reflect the beam of light emitted from the jam safety photo switch back to the photo switch. At the time the walking stick has advanced case 796*c* to the stick's forwardmost position, the walking stick pivot 143 is at substantially the same elevation as the axes of rotation of shafts 118, 120 and on the opposite side of shaft 120 from shaft 118 and pivot 144 is at the same elevation as the axes of rotation of shafts 119, 121 and on the opposite side of shaft 121 from shaft 119. At this time the cams are at the point of their cycle of operation for the respective member operated thereby as indicated by line 815 in the timing chart of FIG. 19 and the walking stick is in the position indicated in FIG. 20. As the walking stick is moved downwardly and rearwardly it moves out of engagement with the erected case blank 795*c* and engages the actuator of the case-in-position limit switch 546 to close switch member 545 and thereby energize compressor timer control 544, and opens switch member 597. The energization of control 544 opens switch 531 and closes switch member 547 for a preselected period of time and then moves the switch members respectively back to a closed and an open condition. The period of time is sufficient for the press plate 386 to be moved to seal the flaps as will be described. However in the event that case blank 796*c* has not been pushed sufficiently forwardly to be out of the beam of light of the photo switch 507, namely allow beam of light emitted therefrom and reflected off the piece of reflective tape 830 on the flap guide 146 back to its control, switch member 509 is in an open condition and as a result of switch member 531 then being moved to an open condition the circuit for energizing the DC motor-starter relay 470 is broken so that switch members 519, 469 open and the machine shuts down until restarted. This is a jam safety feature whereby the machine would be shut down, for example if a case blank pushed forwardly into the compression station by the walking stick were not opened or sidewall 799 was inclined rearwardly and upwardly at a substantial angle. Assuming that case blank 795*c* was properly opened and positioned, the closing of switch 547 energizes the solenoid coil of the compression ram 549 so that it moves its valve member to fluidly connected ports 763, 766 and apply air under pressure to the compression cylinder 391 to move the press plate into the open case blank to complete the folding of the case bottom major flaps and compress the flaps 800–803 as will be described hereinafter.

At the time the walking stick is in the position shown in FIG. 20, the folder in and erector vacuum off cam 183 is in a position that switch member 674 is closed and switch members 671, 677 are open. As a result the solenoid coil of the erector vacuum valve 678 is energized whereby port 754 is fluidly connected to port 755 for applying vacuum from the vacuum pump 759 to the erector cups 277, 291. The erector assembly dwells in the position indicated in FIGS. 2 and 20 just long enough for the cups 277, 291 to grippingly engage the major flaps 801, 800 and then the erector cam through the linkage previously described pivots the erector arm 261 in the direction of the arrow 269 to raise the upper cup to the position shown in FIG. 9 and the lower cup assembly cam through the linkage previously described to move the lower cup 291 from an elevation slightly above top surface of flap guide 146 to about the same elevation as said top surface. Since the lower cup is then held in a stationary condition, as the upper cup continues to pivot in the direction of arrow 269 it moves the major flap 801, the top side wall 797 and the flap 805 horizontally aligned therewith vertically upwardly and forwardly (translatorily swung in the direction of arrow 816 of FIG. 10) so that the minor side walls, flaps 802, 803 and flaps 807, 806 are swung to extend perpendicular to the lower major side wall 796 to open the case blank. After the upper cup 277 starts to pivot to its elevated case erected position of FIG. 9, the rear flap folder cam through linkages previously described start to pivot the vertical shaft 200 in the direction opposite arrow 206 to move the rear folder 205 from the "out" position of FIG. 1A toward the "in" position shown in FIG. 4. Just after the upper cup has been moved to its uppermost position where it dwells, the folder fingers 205 contact the rear minor flap 803 to fold it inwardly to extend at 90° relative the minor side wall 799 to the position shown in FIG. 12. Thence cam 183 rotates to a position to open switch member 674 and close switch members 671, 677.

Figure 12:
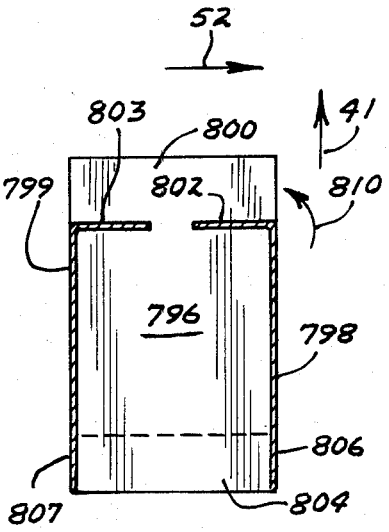
FIG. 12 is a horizontal cross-sectional view of a case blank in an erected condition with the minor flaps at one end folded inwardly.

The closing of switch member 677 energizes the coil of the front minor and upper major flap folder valve 678 to move its valve member for applying air under pressure to port 749 of the minor front flap folder cylinder 253 and port 746 of the major upper flap folder cylinder 338. The check valve flow regulator combination 745 result in the partial folding of the major flap 801 taking place after the minor front flap 802 has been folded. As air under pressure is applied to port 749, folder 241 is pivoted in the direction of arrow 257 about pivot 255 from the retracted "out" position of FIG. 1A to the flap folded "in" position of FIG. 4 to fold flap 802 inwardly in the direction of the arrow 810 toward flap 803 to extend at right angles to end wall 798 as shown in FIG. 12. The application of air under pressure to port 746 results in the upper flap folders 326, 321 being pivoted in the direction of arrow 817 about shaft 323 from a generally horizontal "out" position shown in FIG. 21 to the flap folded "in" position of FIG. 7 wherein flap 801 is folded to extend downwardly and away from the upper side wall 797 at an acute angle, for example 40° to hold flaps 802, 803 in their folded condition. In this connection it is to be noted that the opening of switch member 674 resulted in the discontinuance of the application of vacuum to the upper and lower cups prior to the partial folding of flap 801 as was above described.

After the partial folding of flap 801, the lower flap folder and case stop cam through linkage previously described began to pivot folders 301, 306 in the direction 818 about shaft 303 from the "up" position shown in FIG. 6 to the "down" position whereat the folder leg 301*b* and folder 306 extend generally horizontally and at approximately the same elevation as the top surface of flap guide 146. Then folder leg 301*a* no longer blocks forward movement of flap 800 (and case 796*b*). Just as folders 301, 306 are pivoted the maximum amount in the direction of arrow 818, the walking stick has been moved to a position to engage minor side wall 799 of the erected case 795*b*. It is to be noted that as the walking stick pivots are moved rearwardly to be vertically beneath the shafts 118, 119 respectively and thence further advanced, the walking stick is first moved rearwardly and upwardly and thence upwardly and forwardly. As the walking stick is being moved upwardly, it moves up through the notch 92 in the deck 91 to be rearwardly of the end wall 799 blank 795*b* in the case opened position.

As the walking stick is being moved upwardly and a little before it engages the erected case blank 795*b*, the walking stick operates the actuator of case feed switch 526 to move switch member 525 to an open condition and switch 573 to a closed condition. It is to be noted that during the period of time that the case blank 795*b* was in part on conveyor belts 84 the flap guide 146 and guide rail 48, and up until the time it is properly erected, the blank interrupted the beam of light from the erect safety photo switch 513 so that the light could not impinge upon and reflect back from tape 94. As a result switch member 515 was in an open condition. In the event the case blank has not been properly erected and has a portion extending backwardly to prevent the beam of light reflecting off tape 94, when switch member 525 is opened the circuit for energizing the coil 512 of the DC motor-starter relay is broken and as a result the machine is turned off. This is another safety feature so that the machine is turned off rather than having a case blank that has not been properly erected being moved forwardly by the walking stick and another case blank being fed to the infeed mechanism. Assuming the case blank 795*b* is properly erected so that switch member 515 is closed, the closing of switch member 573 of the case feed limit switch energizes the case feed relay 575 whereupon it closes its switch member 585 and opens switch member 598. Since at this time no case blank extends sufficiently rearwardly on belts 84 to interrupt the beam of light of case-in-position photo switch 560 and the case-in-position relay 564 is energized to hold its switch members 584, 594 closed, the closing of the case feed relay switch member 585 provides a hold-in circuit for retaining relay 575 energized after the walking stick moves out of contact with the actuator of the case feed limit switch 526 and its switch member 573 opens. At the time the case feed relay 575 is energized, the timer coil 587 of the case feed timer is energized to after a preselected time delay moves its switch member 614 to a closed position for energizing case feed in coil 615 of valve 616. The time delay is set such that when case blank 795*a* is moved forwardly, it will not hit the walking stick which then is being moved forwardly. The energization of the case feed in coil 615 moves valve member 710 to fluidly connect port 706 to port 708 and thereby apply air under pressure to port 711 of the case feed cylinder 55. This moves the carriage plate 49 and the case 795*a* that is being carried by cups 67 forwardly so that the advanced edge of blank 795*a* is fed into the entry nip between conveyor belts 84 and rollers 99 and thence fed further forwardly by said belts and rollers. The vacuum mounting bar 64 in moving forwardly moves out of contact with pickup back switch 624 and as a result switch 624 opens. Blank 795*a* in being moved forwardly moves to a position to be sufficiently close to the proximity photo switch 644 so that the control 645 thereof operates switch member 646 to an open condition and retains it in an open condition until the trailing edge of blank 795*a* has been fed forwardly of the carriage plate and the structure mounted thereon. The opening of switch member 646 deenergizes the case infeed relay 626 to open switch members 641, 625. The opening of switch member 641 deenergizes the solenoid coil of the pickup vacuum valve 642 and as a result port 730 is connected to exhaust port 732 to discontinue the application of vacuum to blank 795*a* after the case blank 795*a* has been sufficiently advanced in the direction of arrow 52 to be grippingly engaged by the conveyor belts 84 and rollers 99 which will continue to advance blank 795*a*. After the discontinuance of the application of vacuum, case pickup switch member 610 resiliently returns to an open position and switch member 618 to a closed position to energize case feed out coil 620. Consequently the carriage plate is retracted.

As the case blank 795*a* is moved forwardly by rollers 99 and conveyor belts 84 the leading edge thereof moves into position to block the reflection of the beam of light from the case photo switch 560 back thereto by tape 93 and as a result control switch member 562 moves to an open condition to deenergize relay 564. This opens switch members 584, 594, however the opener forward relay coil 608 remains energized since switch member 597 is closed at this time. The opening of switch 584 results in the case feed relay 575 and the case feed timer 588 being deenergized. The deenergization of the timer results in case feed in coil 615 being deenergized. As the case blank moves forwardly by belts 84, guide 96 aids in retaining the blank with its edge 808 perpendicular to the direction of arrow 52.

After case 795*a* has moved forwardly by belts 84 so that the leading edges of one or both of flaps 800,802 abut against the leg 301*a* which is then dwelling in its "up" position, the trailing edge of the case blank is moved sufficiently forwardly that the beam of light from the photo switch 560 again reflects off tape 93 so that the photo switch closes switch member 562 and thereby energizes the case-in-position relay 564. In the event the case blank 795*a* is not moved sufficiently forwardly to have photo switch member 562 closed, at the time the walking stick operates the case-in-position limit switch 546 to open switch member 597, the open forward relay 608 is deenergized and as a result power is no longer supplied to the DC motor for driving it forwardly. Thus if there is a case blank on deck 91 that has not been advanced sufficiently forwardly to be properly erected, at the time the walking stick operates the case-in-position limit switch 546, the power for automatically driving the walking stick to move it to return to a position for advancing another case will be stopped until photo switch member 562 is closed. This provides a safety feature.

When case blank 795*a* is moved adjacent the position that the case blank leading edge is slightly more than the longitudinal length of one of the major side walls from lower flap folder leg 301*a*, the blank interrupts the beam of light of the erect safety switch 513 to open switch member 515 and then switch member 515 remains in an open condition until the case blank is properly erected by the erector assembly as has been previously described. In the above mentioned manner, case 795*a* is fed from the position shown in FIG. 20 to the position indicated for case blank 795*b* where the leading edges of flaps 800, 801 abut against leg 301*a* in its flap folded position to prevent further forward movement of the blank by belts 84. Additionally when case blank 795*a* has been moved sufficiently in advance of the position that the photo switch control 645 retains switch member 646 in an open position, switch member 646 moves to a closed position and the case infeed relay is again energized to close switch member 625 so that another case blank is picked up from the stack of case blanks and moved to the position illustrated for case blank 795*a* in a manner previously described.

Returning again to the point in cycle that the walking stick initially engaged erected case 795*b* and the lower flap folders have been pivoted in the direction of arrow 818 ("down") to a position leg 301*a* no longer blocks advancement of blank 795*b*, further forward movement of the walking stick moves the erected case 795*b* forwardly of leg 301*a* and the lower flap follower cam through the linkage described begins to pivot folders 301, 306 in the direction opposite arrow 818 through an acute angle, for example about 40°, to the position shown in FIGS. 6 and 7 to partially fold the lower flap. After the partial folding of the lower flap, the walking stick moves the erected case adjacent to and then past the fiber optic scanner emitter receiver cable terminal end (not shown) so that the scanner switch member 662 is moved between open and closed positions for energizing and deenergizing relay 664 and thereby energizing and deenergizing the glue gun valve 672 for applying air under pressure to port 782 at the appropriate times for spraying a pattern of glue (adhesive) onto the minor flaps in a manner described in an application Ser. No. 254,997. It is to be noted that at the time the lower folders 301, 306 are returned to the lower flap folded condition of FIG. 6, the cam 183 is in an angular position that switch member 674 is open and switch members 671, 677 are closed.

As indicated in FIG. 19, prior to the walking stick advancing the erected case 795*b*, the press plate (compression ram) was in its retracted (out) position, and that the upper major flap was retained in a partial folded condition by a flap folder. Further, flaps 800, 801 are retained in such a condition by the upper major flap and after the lower flap has been folded the upper and lower flap folders hold the major flaps partially folded until after case blank 795*b* has been advanced sufficiently that its upper and lower flaps are at least in part transversely opposite the back up plate 440 with the terminal edges thereof closely adjacent the back up plate and intermediate the press plate and back up plate. Thereafter as the case blank 795*b* moves in advance of the flap folders, the major flaps are retained in a partial folded condition by the back up plate. Additionally, after the erected case 795*b* has been moved sufficiently in advance of the upper vacuum cup to be out of the path of movement thereof and the rear flap folder has been moved to its retracted position, the erector arm cam allows the erector arm to again pivot ("fall") in the direction opposite arrow 269 to its lowered position of FIGS. 2A, 20. However before the upper cup moves to its lower position, case blank 795*a* has been fed to the position shown in FIG. 20 for case blank 795*b*, and the lower flap folder had been moved to its folded "up" position.

As previously indicated, when the walking stick is in position to be moved downwardly and rearwardly out of engagement with case blank 795*c*, the press plate starts its movement into said case blank 795*c* and is retracted from within the case blank 795*c* prior to the time the leading end wall 798 of erected case blanks 795*b* engages case blank 795*c*. As case blank 795*b* is moved forwardly to be closely adjacent to case 795*c*, it interrupts the beam of light from the jam safety photo switch 507 so that switch member 509 is moved to an open position. As case blank 795*b* is pushed into and in engagement with case blank 795*c* it pushes case blank 795*c* out of the compression station while just prior thereto it engages the squaring bar 346 to pivot it in a direction opposite arrow 348 so that the case blank 795*b* may move thereunder. Thereafter forward movement of case blank 795*b* brings its upper side wall into abutting relationship with hold down plate 349 while the front part of the hold down plate is still abutting against the upper side wall of case 795*c*. Since the hold down plate is pivotable about two separate axis it is to be noted that hold down plate main body portion may be sloped at an inclined angle in the event that only a part of the hold plate abuts against a case blank.

As case blank 795*b* was pushed forward by the walking stick the longitudinal terminal edge of flap 804 is adjacent lower flap guide rail 429 which aids in retaining the erected case minor side walls substantially perpendicular to the direction the case blank is moved by the walking stick. As the case blank is moved in advance of flap guide 146, it moves onto center guide 435.

When case blank 795*b* has been pushed its maximum distance forwardly by the walking stick, it is moved out of engagement with the bottom surface of the squaring bar and as a result the squaring pivots in the direction of arrow 348 to be abuttable against the case blank 795*b* adjacent the juncture of side walls 797, 799 to prevent backward movement of this portion of the case. At this time the case blank 795*b* is forwardly of the beam of light emitted by photo switch 507 and it again closes its switch member 509.

Now the walking stick engages the case-in-position actuator of limit switch 546 to open switch member 597. In the event case 795*a* has not been sufficiently advanced to clear the beam of light from photo switch 560, the case-in-position relay 564 will be deenergized and switch member 594 will be open so that opener forward relay 472 will be deenergized to deenergize the DC motor 126, thereby interrupting the drive to the walking stick until switch member 562 closes. However, it will be assumed that case 795*a* is in a proper position and accordingly motor 126 continues to operate.

Further, the case-in-position limit switch 546 has its switch member 545 closed for a sufficient period of time to energize the compression timer relay 530. The relay moves its switch member 531 to an open condition and its switch member 547 to a closed position and retains them in such positions for a sufficient time to complete the formation of the bottom closure as will be described hereinafter even though the timer control 544 is deenergized prior to the end of such a period of time. The closing of switch member 547 energizes the compression ram valve 549 to move its valve member for applying air under pressure from port 763 to port 766 and thereby to port 771 of the compression cylinder 391. This results in the press plate moving toward the back up plate and into case 795*b*. However, in the event the case 795*b* has not been moved forwardly sufficiently to avoid breaking the beam of light from the jam safety photo switch 507 prior to switch member 531 opening, the machine is turned off before the press plate is moved into the case blank. Assuming case blank 795*b* is in advance of the last mentioned beam of light, as the press plate moves into the area bounded by the flaps 797 and 804–806, the portion bracket 398 which extends further rearwardly than the rearward edge of plate 386 engages flap 807 and subsequently minor side wall 799 to square the case in the event such flap and wall should be inclined forwardly in an upward direction. In this connection it should be noted that the longitudinal distance between flaps 807, 806 in a properly open condition is somewhat greater than the corresponding dimension of the press plate and that when said flaps extend perpendicular to the horizontal, bracket 398 in moving into the case blank will not move the case blank rearwardly. The location where the bracket engages the case blank is at a higher elevation than the major flap 804 and side wall 796.

Since flaps 800, 801 in a partially forward condition retain flaps 802, 803 to extend toward one another in substantially a vertical longitudinal plane, the press plate in being moved into engagement with flaps 802, 803 push the case blank toward the backup plate. The backup plate resists the movement of the case blank in the direction of the arrow 41 in that it abuts against the longitudinal terminal edges of flaps 800, 801. The press plate in pushing against flaps 802, 803 result in said terminal edges of flaps 800, 801 moving together from the position shown in FIG. 7 toward a fully folded position. At the time the case blank has been moved in the direction of the arrow 41 to the dotted line position shown in FIG. 7, flaps 800, 801 are pressed against the glue that had been previously sprayed on flaps 802, 803 and have their longitudinal and terminal edges closely adjacent one another. The press plate dwells in this position to compress flaps 800–804 between it and the backup plate for a period of time sufficient to form a good sealed bottom closure. Thereafter the compression timer times out and opens switch member 547 to deenergize the compression ram valve and closes switch member 531. The deenergization of the compression ram valve results in the press plate being retracted to its "out" position of FIG. 7 to be completely out of the way of the movement of the next case blank into the compression station.

As the press plate is retracted from within the case blank, even if the case blank is no longer in part being supported by guide rail 428, the hold down bar 439 will retain it on center guide 435.

After the leading portions of the longitudinal terminal edges of flaps 800, 801 engage the backup plate to prevent the flaps moving away from their partially folded position, and the upper major side wall has been moved to abut against squaring bar 346, but prior to the press plate being moved into the case, cam 183 has moved angularly to a position that switch member 677 is open to deenergize the front minor and top major flap folder valve whereupon the minor folder cylinder 253 and the major folder cylinder 338 retract their piston rods. As a result, the upper major flap folders 321, 326 are moved in the direction opposite arrow 817 from the solid line "in" position of FIG. 7 to their retracted "out" position and the front minor flap folder 241 is moved from its "in" folded position of FIG. 4 to its retracted "out" position of FIG. 1A. Further, at the time switch member 677 opens switch member 671 opens to deenergize the glue valve 672 and switch member 674 closes to energize the erector vacuum valve 678 so that a vacuum is applied at the erector cups prior to upper cup 277 moving to its fully lowered position and subsequent to engage blank 795*a* which is then abutting against leg 301*a* of the lower flap folder.

In the event it is desired to run the machine without automatically feeding a case blank to the position of case blank 795*b* of FIG. 20, the case feed switch 569 is left in the off position. Upon opening air valve 702, depressing switch 517 and applying power across main lines $L_1$–$L_4$, and with either one of switch members 525 and 515, and either one of switch members 509 and 531 closed, the DC motor 126 will be energized and the walking stick and cam operated structure will be operated through their cycles of movement as believed can be understood from the prior description. Should it be desired to control the increments of movement of the walking stick and the cam operated structure, with the conditions the same as referred to above except that switch 569 is opened or closed and switch 570 in the jog position, the operation of the walking stick and cam operated structure may be in a forward drive mode or a reversed mode. With switch 570 in a jog mode, switch members 551, 571 are open and switch member 603 is closed. To operate in the reverse jog mode and with the DC motor relay energized and the jog forward switch 599 with its switch member 601 closed and switch member 600 open, upon depressing the jog reverse switch 607 and as long as it is depressed the DC motor is driven in a reverse condition. On the other hand if it is desired to operate in the forward jog mode switch member 607 is not depressed and then when and as long as the jog forward switch 599 is depressed switch member 600 is closed to energize the DC motor. The jog modes might be used, for example in making adjustments of various parts for forming bottom closures on case blanks of a different size.

What is claimed is:

1. For erecting and folding a flat folded case blank having minor first and second flaps, which are respectively joined along fold lines to the to transverse ends of first and second minor side walls of a case blank, and major third and fourth flaps, which are respectively joined along fold lines to one transverse ends of major third and fourth sidewalls, each of said flaps having a longitudinally extending terminal edge substantially parallel to the respective fold line and substantially spaced therefrom and the minor sidewalls being joined to opposed edges of the major sidewalls, case erector and bottom sealer apparatus comprising a longitudinally elongated frame having a rear end portion and a front end portion, first means at the frame rear end portion for supporting a stack of the flat folded blanks in vertical stacked relationship with each blank having its first and third flaps and sidewalls above its second and fourth flaps and sidewalls second means on the frame for picking up a flat folded case blank from the stack of case blanks on the first means and feeding the picked up blank forwardly to a case blank erecting station on the frame, third means mounted on the frame for supporting a case blank at the erecting station, fourth means mounted on the frame for releasably grippingly engaging at least one of the fourth flap and fourth sidewall of a case blank at the erector station, operable fifth means mounted on the frame for releasably grippingly engaging at least one of the third flap and third sidewall of a case blank grippingly engaged by the fourth means and erecting the gripped case blank, operable sixth means mounted on the frame for movement between a retracted and a flap folded position for folding the second flap of the erected case blank to extend generally toward the first sidewall, operable seventh means mounted on the frame for movement between a retracted and a flap folded position for folding the first flap of the erected case blank to extend generally toward the second sidewall, operable eighth means mounted on the frame for movement between a retracted position and a flap folded position for at least partially folding the third and fourth flaps to hold the first and second flaps in their folded condition, ninth means for applying adhesive to at least some of the flaps on areas of the flaps to adhere the third and fourth flaps to the first and second flaps when the first and second flaps are pressed against the third and fourth flaps, operable tenth means mounted on the frame for moving the erected case blank from the erecting station, past the ninth means and to a compression station at the frame front end portion, eleventh means on the frame for supporting an erected case blank as it is moved from the erecting station to the frame front end portion, operable twelfth means on the frame at the frame front end portion to compress the flaps to form a sealed case closure and control means for operating the second and fourth means and controlling the operation of the fifth, sixth, seventh, eighth, tenth and twelfth operable means, the second means including means for supportingly conveying at least one of the fourth flap and the fourth sidewall, and the eighth means including lower flap folder means for moving from a retracted position to a flap folded position for folding the fourth flap and means joined to the lower folder means for movement therewith for stopping forward movement of a case blank on the supportingly conveying means when the lower folder means is in its folded position.

2. The apparatus of claim 1 further characterized in that the fourth means includes a lower vacuum cup for grippingly engaging at least one of the fourth flap and side wall, an upper vacuum cup for grippingly engaging at least one of the third flap and third sidewall, means for mounting the upper vacuum cup on the frame for swinging movement between a lower position to grippingly engage a flat folded case blank at the erecting station and an elevated case blank erected position and means for mounting the lower vacuum cup on the frame and lowering the lower cup slightly after the cups have grippingly engaged the case blank.

3. The apparatus of claim 1 further characterized in that the tenth means includes a vertically elongated walking stick, and means mounted on the frame for mounting the walking stick and translating the walking stick through a path of movement that includes moving the walking stick forwardly extending to an elevation to engage an erected case blank at the erecting station and push the erected case blank to the compression station, and rearwardly extending to an elevation to move beneath a case blank at the erecting station, the last mentioned means including a first, a second, a third and a fourth shaft, means mounting said shafts on the frame to rotate about parallel transverse axes with the first and second shafts directly vertically above the third and fourth shafts respectively, and the first and third shafts a substantial distance longitudinally forwardly of the second and fourth shafts. respectively, a first chain extended around first and second sprockets to have longitudinally elongated upper and lower runs, a second chain extended around third and fourth sprockets to have longitudinally elongated upper and lower runs, means for pivotally connecting the walking stick to each of the chains at the same relative location on the respective chain, and means for driving at least one each of the first and second, and third and fourth shafts to move the upper runs at the same linear speed.

4. The apparatus of claim 1 further characterized in that each of the fifth, sixth, seventh, eighth, tenth and twelfth operable means is power actuated, that the tenth means includes a walking stick and means for moving the walking stick forwardly in engagement with an erected case blank at the erecting station until the erected blank is at the compression station and rearwardly to return the walking stick to a position rearwardly of an erected case blank at the erecting station, and that the control means includes means for supplying power to all the power actuated means, and means for controlling the application of power from the power supply means to all the power actuated means, and discontinuing the application of power after the walking stick has moved forwardly from a position to engage one erected case blank at the erecting station to a position to push the last mentioned blank to the compression station and the fourth and fifth means have been operated to erect a second flat folded case blank subsequent to erecting said one erected case blank and prior to the walking stick moving to a position to engage a second erected case blank in the event the second flat folded case blank has been fed to the erecting station and either is incompletely erected or still is flat folded.

5. The apparatus of claim 1 further characterized in that each of the operable means is power actuated, that the twelfth means includes a press plate movable into an erected case blank at the compression station, and operable means on the frame for moving the press plate between a retracted position exterior of an erected case blank at the compression station and a case blank flap pressing position within an crected case blank, and that the control means includes means for supplying power to the power actuated means, means for controlling the application of power from the power supply means to the power actuated means, and discontinuing the application of power after a case blank has been moved to the compression station and prior to the press plate having been moved from its retracted position to the position for pressing flaps of the last mentioned blank in the event the said last mentioned blank extends rearwardly of a predetermined location at the compression station.

6. The apparatus of claim 1 further characterized in that the tenth means includes an abutment mechanism for moving a case blank and operable means for moving the abutment mechanism through a path of movement forwardly from a position rearwardly of an erected case blank at the erecting station to a position to move the last mentioned case blank to the compression station and then rearwardly to said position rearwardly of an erected case blank, and that the control means includes means for stopping movement of the abutment mechanism moving means in the event either the next subsequent case blank is being fed to the erecting station and extends into a position that is rearwardly of a preselected position for a case blank to be erected or said next susequent case blank has been fed so that it still extends into a position that is rearwardly of the preselected positioned, after the abutment mechanism has moved the preceding case blank to the compression station and prior to the abutment mechanism being moved to said position rearwardly of an erected case blank.

7. For erecting and folding a flat folded case blank having minor first and second flaps, which are respectively joined at fold lines to one transverse ends of first and second minor sidewalls of the case blank and major third and fourth flaps which are respectively joined along fold lines to one transends of major third and fourth sidewalls, each of said flaps having a longitudinally extending terminal edge substantially parallel to the respective fold line and substantially spaced therefrom and the minor sidewalls being joined to opposite edges of the major sidewalls, case erector and bottom sealer apparatus comprising a longitudinally elongated frame having a front end portion and a rear end portion, a flat folded case blank pick up station at the rear end portion, a compression station at the front end portion and an erecting station intermediate the pick up and compression stations, first means on the frame for supporting a case blank for movement from rearwardly of the erecting station to and through the compression station, second means mounted on the frame for receiving a picked up case blank and moving the picked up blank to the erector station, third means mounted on the frame for picking up a case blank from a stack of flat folded case blanks and feeding the picked up blank to the second means with the picked up blank first and third flaps and sidewalls above its second and fourth flaps and sidewalls, operable fourth means for gripping at least one of the third flap and sidewall and one of the fourth flap and sidewall while the flat folded blank is on the first means at the erecting station and opening the last mentioned blank to have the second flap and sidewall extend generally perpendicular to the fourth flap and sidewall, fifth means on the frame for folding the first and second flaps inwardly toward one another and then at least partially fold the third and fourth flaps toward one another, the fifth means including means mounted on the frame for movement for folding the first and second flaps inwardly toward one another, operable ninth means mounted on the frame for movement for at least partially folding the third flap and retaining the at least partially folded third flap in the at least partially folded condition until it extends into the compression station and operable tenth means mounted on the frame for movement for at least partially folding the fourth flap and retaining the at least partially folded third flap in the at least partially folded condition until it extends into the compression station, sixth means on the frame for applying adhesive to at least some of the flaps to adhere the third and fourth flaps to the first and second flaps when the first and second flaps are pressed against the third and fourth flaps, seventh means for moving the erectd case blank along the first means from the erector station, past the ninth and tenth means and to the compression station, eighth means at the compression station for retaining the at least partially folded third and fourth flaps in their at least partially folded condition after the third and fourth flaps extend into the compression station and operable eleventh means movable between a retracted position and an extended position cooperating with the eight means for pressing the at least partially folded flaps together to form a sealed case closure when the case blank is at the compression station and control means for operating the second and third means and controlling the operation of the fourth, ninth, tenth and eleventh operable means.

8. The apparatus of claim 7 wherein the case blank erected position at the erecting station the third flap and sidewall are the rear flap and sidewall and the first flap and sidewall are the front flap and sidewall, further characterized in that the fifth means includes a rear flap folder, operable means on the frame for moving the rear flap folder between a rear flap folded position and a retracted position, and that the tenth means includes a lower flap folder and case blank stop, and operable means for moving the lower flap folder and case blank stop between a lowered position permitting the lower flap in an unfolded condition moving thereover as a case blank is moved forwardly on the first means by the seventh means and a lower flap folded position to fold a lower flap that extends thereover and limit forward movement of a flat folded case blank by the second means to a preselected position at the erecting station.

9. The apparatus of claim 8 further characterized in that the control means includes means to operate the fourth means to open a flat folded case blank and then the rear flap operable means to move the rear flap folder toward its flap folded position while the lower flap folder and case blank stop is in its folded position.

10. For erecting and folding a flat folded case blank having minor first and second flaps, which are respectively joined at fold lines to one transverse ends of first and second sidewalls of the case blank, and major third and fourth flaps which are respectively joined along fold lines to one transverse ends of major third and fourth sidewalls, each of said flaps having a longitudinally extending terminal edge substantially parallel to the respective fold line and substantially spaced therefrom and the minor sidewalls being joined to opposite edges of the major sidewalls, case erector and bottom sealer apparatus comprising a longitudinally elongated frame having a front end portion and a rear end portion, a flat folded case blank pick up station at the rear end portion, a compression station at the front end portion and an erecting station between the pick up and compression stations, first means on the frame for supporting a case blank for movement from rearwardly of the erecting station to and through the compression station, operable second means for picking up a flat folded blank at the pick up station and moving the picked up blank along the first means to the erecting station with the flap folded blank first and third flaps and sidewalls above the second and fourth flaps and sidewalls, operable third means to grippingly engage the flat folded blank at the erecting station and opening the last mentioned blank to have the second flap and sidewalls extend generally perpendicular to the fourth flap and sidewall, and the third flap and sidewall respectively above the fourth flap and sidewall, operable fourth means on the frame for folding the first and second flaps of the opened case blank to extend inwardly toward one another and then fold the third flap sufficiently to retain the first and second flaps in a flap folded condition, operable fifth means mounted on the frame for movement between an upper fourth flap folded position to limit the forward movement of a picked up flat folded blank by the second means to a location to be opened by the third means, and a lowered position permitting the fourth flap being moved thereover as the opened blank is moved from the erecting station to the compression station, sixth means for applying adhesive to at least some of the flaps to adhere the third and fourth flaps to the first and second flaps when the first and second flaps are pressed against the third and fourth flaps, operable seventh means at the compression station for pressing together the flaps after adhesive has been applied thereto to form a sealed bottom closure, and operable eighth means for moving an open case blank along the first means for the erecting station to the compression station, and control means for controlling the operation of the second, third, fourth, fifth, seventh and eighth operable means, including operating the fifth means to move from its upper position to its lower position after the third means grippingly engages the folded blank and after the opened blank has started to move over the fifth means in its lower position, operating the fifth means to move to its upper position to fold the fourth flap.

11. The apparatus of claim 10 further characterized in that the third means is operable between a flat folded case blank gripping position and a case blank open position, that all the operable means are power actuated, and that the control means includes means for applying operative power to all the operable means and discontinuing the application of power in the event that when there is a flat folded case blank at the erecting station at the time' the third means is operated to its case blank gripping position andthe third means in moving to its case blank open position fails to open the case blank to have the second wall extend generally perpendicular to the fourth wall, discontinues the application of power to all the operable means before the eighth means is operated to move the last mentioned case blank at the erecting station to the compression station.

12. The apparatus of claim 10 further characterized in that the seventh means includes a press plate and operable means mounted on the frame for moving the press plate from a retracted position exterior of an open case blank at the compression station to a flap pressing position within the case blank at the compression station, that all the operable means are power actuated and that the control means includes means for applying power to all the operable means and discontinuing the application of power to all the operable means after the eighth means has moved one case blank to the compression station and prior to moving the next case blank toward the compression station in the event the one case blank at the compression station extends rearwardly of a position to have the press plate moved thereinto.

13. The apparatus of claim 10 further characterized in that the eight means includes a vertically elongated walking stick and a pair of driven chain means having longitudinally elongated runs for moving and maintaining the walking stick in a vertical condition to push a case blank from the erecting station to the compression station.

14. For erecting and folding a flat folded case blank having minor first and second flaps, which are respectively joined at fold lines to the one transverse ends of the first and second minor sidewalls of the case blank and major third and fourth flaps which are respectively joined along fold lines to one transverse ends of major third and fourth sidewalls, each of said flaps having a longitudinally extending terminal edge substantially parallel to the respective fold line and substantially spaced therefrom and the minor sidewalls being joined to opposite edges of the major sidewalls, case erector and bottom sealer apparatus comprising a longitudinally elongated frame having a front end portion and a rear end portion, a flat folded case blank pick up station at the rear end portion, a compression station at the front end portion and an erecting station intermediate the pick up and compression stations, first means on the frame for supporting a case blank for movement from rearwardly of the erecting station to and through the compression station, operable second means mounted on the frame for picking up a flat folded case blank and moving the picked up blank in a flat folded condition forwardly to the erecting station, operable third means on the frame for opening the flat folded case blank, fourth means on the frame for folding the flaps of the opened case blank, fifth means on the frame for applying adhesive to at least some of the flaps to adhere the third and fourth flaps to the first and second flaps when the first and second flaps are pressed against the third and fourth flaps, operable sixth means at the compression station for pressing the folded flaps together to form a sealed case closure, operable seventh means on the frame for moving a case blank from the erecting station to the compression station, all the operable means being power actuated, and control means for applying power to all the operable means and after the fifth means moves one case blank to the compression station and prior to moving the next blank to the compression station, discontinuing the application of power to the seventh means in the event the next case blank extends forwardly into the erecting station and rearwardly of a preselected position at the erecting station.

15. The apparatus of claim 14 wherein the preselected position is rearwardly of a flat folded case blank at the erecting station.

16. The apparatus of claim 14 wherein a flat folded case blank at the erecting station has a rear transverse edge that is more remote from the fourth means than any other portion of the last mentioned case blank and that said preselected position is longitudinally intermediate the rear transverse edge of a case blank at the erecting station and the fourth means.

* * * * *

UNITED STATES PATENT AND TRADEMARK OFFICE

CERTIFICATE OF CORRECTION

PATENT NO. : 4,498,893

DATED : Feb. 12, 1985

INVENTOR(S) : Robert E. Odom

It is certified that error appears in the above–identified patent and that said Letters Patent are hereby corrected as shown below:

Column 1, line 67, delete "B-B of"; Column 28, line 66, delete "to the"; Column 29, line 13, insert --,-- after "sidewalls"; and Column 33, line 27, change "for" to --from-- and line 46, change "andthe" to --and the--.

Signed and Sealed this

*Twenty-seventh* Day of *August 1985*

[SEAL]

*Attest:*

DONALD J. QUIGG

*Attesting Officer* *Acting Commissioner of Patents and Trademarks*